US008827401B2

(12) United States Patent
Kimura et al.

(10) Patent No.: US 8,827,401 B2
(45) Date of Patent: Sep. 9, 2014

(54) RECORDING DEVICE INCLUDING A DEVICE TO DETECT MISALIGNMENT OF DOTS

(75) Inventors: Tomonori Kimura, Kanagawa (JP); Yasuo Sakurai, Kanagawa (JP); Nobuyuki Satoh, Kanagawa (JP); Masato Kobayashi, Kanagawa (JP); Yuichi Sakurada, Tokyo (JP); Arata Suzuki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 56 days.

(21) Appl. No.: 12/929,629

(22) Filed: Feb. 4, 2011

(65) Prior Publication Data

US 2011/0205275 A1 Aug. 25, 2011

(30) Foreign Application Priority Data

Feb. 8, 2010 (JP) ..... 2010-025391

(51) Int. Cl.
*B41J 29/38* (2006.01)
*B41J 19/14* (2006.01)

(52) U.S. Cl.
CPC ..... *B41J 19/145* (2013.01)
USPC ..... 347/14

(58) Field of Classification Search
None
See application file for complete search history.

(56) References Cited

U.S. PATENT DOCUMENTS

2002/0135629 A1* 9/2002 Sarmast et al. ..... 347/19
2009/0025093 A1 1/2009 Kimura
2009/0316164 A1 12/2009 Takahashi et al.

FOREIGN PATENT DOCUMENTS

JP 2003-011344 A 1/2003
JP 2004-358759 A 12/2004

* cited by examiner

*Primary Examiner* — Geoffrey Mruk
*Assistant Examiner* — Bradley Thies
(74) *Attorney, Agent, or Firm* — Harness, Dickey & Pierce, P.L.C.

(57) ABSTRACT

A recording device having a recording head including a nozzle line that eject ink from nozzles arranged in a transfer direction of a recording medium, a carriage, a moving device that moves the carriage forward and backward, a transfer device that transfers the recording medium, an ejection control device that forms a detection pattern by ejecting the ink, a two-dimensional sensor that detects the detection pattern, an analyzer that analyzes the image data of the detection pattern, and a detection device that detects misalignment of the printed dots, the ejection control device having a first dot group formation device that forms a first dot group, a second dot group formation device that forms a second dot group, and a third dot group formation device that forms a third dot group, the detection pattern being formed of the first dot group, the second dot group, and the third dot group.

8 Claims, 21 Drawing Sheets

FIG. 7

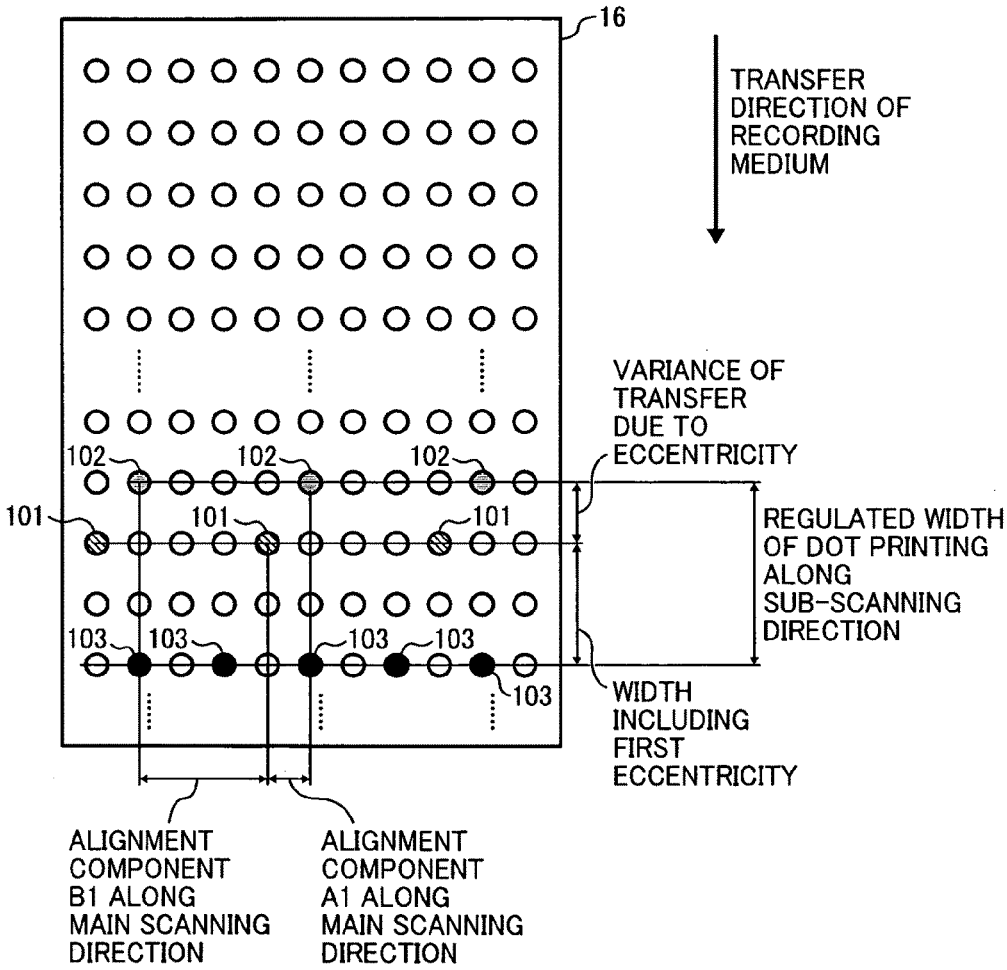

: FIRST DOT GROUP 101 CONSTITUTED OF DOTS PRINTED WHILE SCANNING IN OUTWARD DIRECTION AT ROLLER REFERENCE POSITION

: SECOND DOT GROUP 102 CONSTITUTED OF DOTS PRINTED WHILE SCANNING ALONG RETURN DIRECTION AFTER TRANSFER OF RECORDING MEDIUM ONCE

: THIRD DOT GROUP 103 CONSTITUTED OF DOTS PRINTED WHILE SCANNING ALONG RETURN DIRECTION AFTER TRANSFER OF RECORDING MEDIUM ONCE

MAIN SCANNING IDEAL TWO DIMENSIONAL FOURIER TRANSFORM RESULTS

MAIN SCANNING ALIGNMENT

MAIN SCANNING MISALIGNMENT
TWO DIMENSIONAL FOURIER TRANSFORM RESULTS

SUB-SCANNING IDEAL TWO DIMENSIONAL FOURIER TRANSFORM RESULTS

SUB-SCANNING MISALIGNMENT TWO DIMENSIONAL FOURIER TRANSFORM RESULTS

MAIN SCANNING AND SUB-SCANNING MISALIGNMENT TWO DIMENSIONAL FOURIER TRANSFORM RESULTS

MAIN SCANNING IN THE CASE OF ASSEMBLY ERROR

: FIRST DOT GROUP 101 CONSTITUTED OF DOTS PRINTED BY REFERENCE HEAD

: SECOND DOT GROUP 102 CONSTITUTED OF DOTS PRINTED BY ADJUSTMENT HEAD

: FIRST DOT GROUP 101 CONSTITUTED OF DOTS PRINTED BY REFERENCE HEAD

: SECOND DOT GROUP 102 CONSTITUTED OF DOTS PRINTED BY ADJUSTMENT HEAD

RECORDING DEVICE INCLUDING A DEVICE TO DETECT MISALIGNMENT OF DOTS

BACKGROUND OF THE INVENTION

1. Field of the Invention

The present invention relates to a recording device such as an ink jet printer, and a control method therefor.

2. Description of the Background Art

Recording devices employing an ink jet printing system print images (dots) on recording media by ejecting ink from recording heads while moving the heads in the forward (outward) and backward (return) directions to attach ink to the recording media. Then, the recording media are transferred by transfer rollers, etc. in the sub-scanning direction (transfer direction) and recording is repeated in the main scanning direction (perpendicular to the transfer direction) to form entire images on the recording media.

However, with such a recording device, which prints an image formed by dots on a recording medium while moving the recording heads back and forth in the main scanning direction, images (dots) recorded while moving the record heads forward are easily misaligned with images (dots) recorded while moving the record heads backward.

Therefore, typically the timing of ejecting ink in the forward and backward directions is adjusted to cancel out such misalignment of printing. This adjustment of the timing of ejecting ink is conducted using predetermined adjustment patterns.

For example, in Japanese patent application publication no. 2004-358759 (JP-2004-358759-A), an outward pattern serves as a reference and a return pattern is superimposed on the outward pattern.

The outward pattern is a reference adjustment pattern formed when the recording head is moving outward and the return pattern is a pattern formed for adjustment when the head is returning. Next, the superimposed adjustment pattern is detected and an optimal adjustment pattern is determined by observation with the naked eye based on changes in the density and color of the detected adjustment pattern. Misalignment of images is corrected using the optimal adjustment pattern.

SUMMARY OF THE INVENTION

However, a determination by observation with the naked eye is a subjective judgment that varies depending on the user, meaning that accurate detection of misalignment of printing is difficult.

For these reasons, the present inventors recognize that a need exists for a recording device and a control method that can accurately detect misalignment of dots.

Briefly this object and other objects of the present invention as hereinafter described will become more readily apparent and can be attained, either individually or in combination thereof, by a recording device including a recording head having a nozzle line having multiple nozzles that eject ink and are arranged in the transfer direction of a recording medium, a carriage onto which the recording head is mounted, a moving device that moves the carriage forward and backward in a direction perpendicular to the transfer direction of the recording medium, a transfer device that transfers the recording medium, an ejection control device that forms a detection pattern on the recording medium by ejecting the ink from the nozzles at an arbitrary timing to print dots on the recording medium with the ink when the carriage is moving in a forward direction and a backward direction, a two-dimensional sensor that detects the detection pattern formed on the recording medium and obtains image data of the detection pattern, an analyzer that analyzes the image data of the detection pattern obtained by the two-dimensional sensor and obtains two-dimension frequency characteristics of the detection pattern, and a detection device that detects misalignment of the dots printed when the carriage is moving in the forward direction and the backward direction based on the two-dimension frequency characteristics obtained by the analyzer. The ejection control device includes a first dot group formation device that forms a first dot group on the recording medium when the carriage is moving in the forward direction by ejecting the ink multiple times to print the dots a constant distance apart in the direction perpendicular to the transfer direction using the nozzles located on an upstream side among the nozzles in the nozzle line relative to the transfer direction, a second dot group formation device that forms a second dot group on the recording medium by ejecting the ink multiple times using nozzles situated a predetermined distance downstream from the nozzles used to form the first dot group relative to the transfer direction at a timing of printing dots at a center position between two adjacent dots constituting the first dot group when the carriage is moving in the backward direction after the transfer device transfers the recording medium in a predetermined amount, and a third dot group formation device that forms a third dot group on the recording medium when the carriage is moving in the backward direction by ejecting the ink multiple times with nozzles situated a predetermined distance from the nozzles used to form the second dot group relative to the transfer direction at a timing of printing dots at the same positions in the main scanning direction as the dots constituting the first dot group and the dots constituting the second dot group in the direction perpendicular to the transfer direction. The detection pattern is formed of the first dot group, the second dot group, and the third dot group.

It is preferred that, in the recording device mentioned above, misalignment between the dots constituting the first dot group and the dots constituting the second dot group and misalignment of printing between the dots constituting the first dot group and the dots constituting the third dot group are detected based on the two-dimension frequency characteristics obtained by the analyzer.

It is still further preferred that, in the recording device mentioned above, misalignment between the dots constituting the first dot group and the dots constituting the second dot group is detected by comparing frequency characteristics in the direction perpendicular to the transfer direction with a predetermined reference frequency in the direction perpendicular to the transfer direction, and misalignment between the dots constituting the first dot group and the dots constituting the third dot group is detected by comparing frequency characteristics in the transfer direction with a predetermined reference frequency in the transfer direction using the two-dimension frequency characteristics obtained by the analyzer.

It is still further preferred that, in the recording device mentioned above, the detection device detects misalignment between the dots constituting the first dot group and the dots constituting the second dot group by comparing frequency characteristics in the direction perpendicular to the transfer direction obtained by the dots constituting the first dot group and the dots constituting the second dot group with frequency characteristics in the transfer direction obtained by the dots constituting the third dot group, and misalignment between the dots constituting the first dot group and the dots constituting the third dot group by comparing frequency characteristics in the transfer direction obtained by the dots constituting the first dot group and the dots constituting the third dot group with frequency characteristics in the transfer direction obtained by the dots constituting the second dot group and the dots constituting the third dot group.

It is still further preferred that, in the recording device mentioned above, the recording device further includes at least one additional recording heads recording heads, the ejection control device forms the detection pattern containing the first dot group, the second dot group, and the third dot group for each of the recording heads, the two-dimensional sensor detects the detection patterns formed on the recording medium for each of the recording heads and obtain image data of the detection patterns for each of the recording heads, the analyzer analyzes the image data of the detection patterns for each of the recording heads obtained by the two-dimensional sensor and obtains two-dimension frequency characteristics of the detection patterns for each of the recording heads, and the detection device detects misalignment between the dots constituting the first dot group and the dots constituting the second dot group based on the two-dimension frequency characteristics of the detection patterns for each of the recording heads obtained by the analyzer.

As another aspect of the present invention, a method of controlling a recording device is provided which includes the recording device comprising a recording head comprising a nozzle line having multiple nozzles that eject ink and are arranged in a transfer direction of a recording medium a carriage onto which the recording head is mounted, a moving device that moves the carriage forward and backward in a direction perpendicular to the transfer direction of the recording medium, a transfer device that transfers the recording medium, and an ejection control device that forms a detection pattern on the recording medium by ejecting the ink from the nozzles at an arbitrary timing to print dots on the recording medium with the ink when the carriage is moving in a forward direction and a backward direction, the control method including the steps of detecting the detection pattern formed on the recording medium with a two-dimensional sensor and obtaining image data of the detection pattern, analyzing the image data of the detection pattern obtained by the two-dimensional sensor and obtaining two-dimension frequency characteristics of the detection pattern, and detecting misalignment of the dots printed when the carriage is moving in the forward direction and the backward direction based on the two-dimension frequency characteristics.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 7 is a diagram illustrating the detection pattern 100 having misalignment of dots (printing) along the main scanning direction and the sub-scanning direction;

DETAILED DESCRIPTION OF THE PRESENT DISCLOSURE

Recording Device

Figure 1:
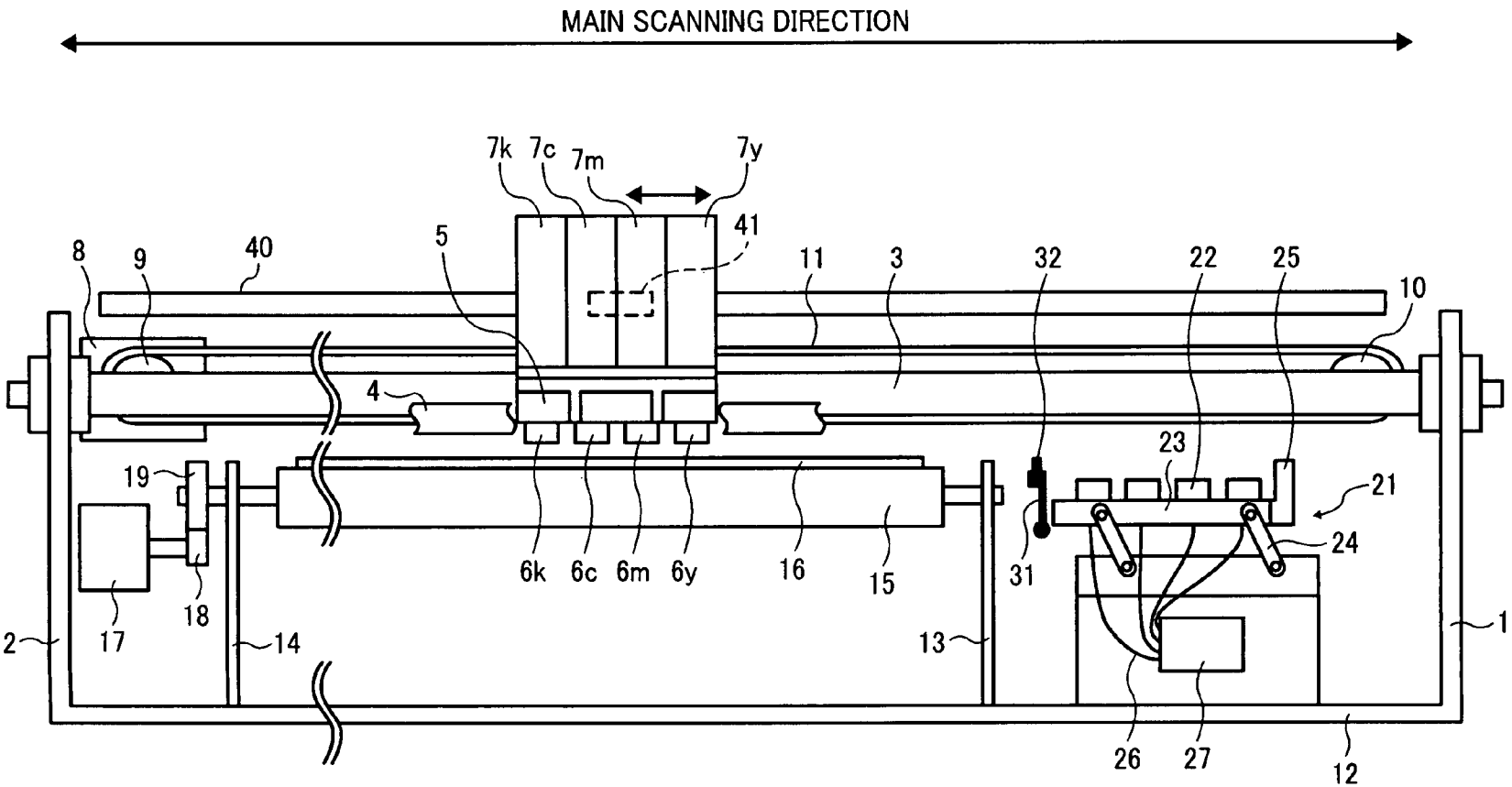
FIG. 1 is a schematic diagram illustrating a structure example of the mechanism part of an embodiment of the recording device of the present disclosure.

First of all, the recording device of the present disclosure is described with reference to FIGS. 2, 3, and 4.

The recording device of the present disclosure includes a recording head 6 having a nozzle line 61 having nozzles that eject ink and are arranged in the transfer direction of a recording medium 16, a carriage 5 having the recording head 6, a moving device (corresponding to a control unit 107 and a main scanning driver 109)

that moves the carriage 5 back and forth in the direction (main scanning direction) perpendicular to the transfer direction of the recording medium 16, a transfer device (corresponding to the control unit 107, a sub-scanning driver 113, and a paper transfer unit 112) that transfers the recording medium 16, an ejection control device (corresponding to the control unit 107 and a recording head driver 111) that ejects ink from the nozzles at an arbitrary timing while the carriage 5 is moving back and forth to print dots on the recording medium 16 with ink and form the detection pattern 100, a two-dimension sensor 30 that detects the detection pattern 100 formed on the recording medium 16 and obtains image data of the detection pattern 100, an analyzer (corresponding to the control unit 107) that analyzes the image data of the detection pattern 100 and obtains two-dimension frequency characteristics of the detection pattern 100, and a detection device (corresponding to the control unit 107) that detects misalignment of dots while the carriage 5 is moving back and forth based on the two-dimension frequency characteristics.

The ejection control devices 107 and 111 have a first dot formation device, a second dot formation device, and a third dot formation device. The first dot formation device forms a first dot group 101 on the recording medium 16 by ejecting ink multiple times in the direction (main scanning direction) perpendicular to the transfer direction a constant distance apart using nozzles arranged on the upstream side of the nozzle line 61 relative to the transfer direction while the carriage 5 is moving in the outward direction. After the transfer devices 107, 113, and 112) transfer the recording medium in a predetermined amount, the second dot formation device forms a second dot group 102 by ejecting ink on the recording medium 16 multiple times using nozzles arranged on the downstream side with a predetermined amount apart from the nozzles that form the first dot group 101 relative to the transfer direction at a timing of printing dots on the center position between two adjacent dots constituting the first dot group 101 while the carriage 5 is moving in the return direction. The third dot formation device forms a third dot group 103 by ejecting ink on the recording medium 16 multiple times in the direction (main scanning direction) perpendicular to the transfer direction at a timing of printing dots at the same position in the main scanning direction of the dots constituting the first dot group 101 and the dots constituting the second dot group 102 with regard to the direction (main scanning direction) perpendicular to the transfer direction using nozzles arranged with a predetermined amount apart from the nozzles that form the second dot group 102 relative to the transfer direction while the carriage 5 is moving in the return direction. The ejection control devices 107 and 111 form a detection pattern 100 formed of the first dot group 101, the second dot group 102, and the third dot group 103.

Therefore, the recording device of the present disclosure is able to exactly detect misalignment of dots.

Embodiments of the recording device are described with reference to accompanying drawings.

First Embodiment

Schematic Structure Example of Mechanism Portion of Recording Device

First of all, a schematic structure example of the mechanical portion of the recording device of the present disclosure is described with reference to FIG. 1.

The recording device of this embodiment is structured to have a main support guide rod 3 and a sub-support guide rod 4 laid across substantially horizontal to each other between side plates 1 and 2 situated on both sides to support the carriage 5 so as to make it slidably move along the main scanning direction.

The carriage 5 includes four recording heads 6 that eject yellow ink, magenta ink, cyan ink, and black ink with their ejection surfaces (nozzle surfaces) downward.

In addition, the carriage 5 includes replaceable four ink cartridges 7 (numeral reference 7 represents any or all of each ink cartridges) provided on the recording heads 6 (numeral reference 6 represents any or all of each recording head).

The ink cartridges 7 are ink suppliers that supply ink to the four recording heads 6.

The carriage 5 is connected to a timing belt 11 suspended between a driving pulley (driving timing pulley) 9 rotated by a main scanning motor 8 and an idler pulley 10 so that the carriage 5 can move along the main scanning direction by controlling driving of the main scanning motor 8.

An encoder sensor 41 is provided to the carriage 5. The encoder sensor 41 detects a mark of an encoder sheet 40 and obtains an encoder value by which moving of the carriage 5 in the main scanning direction is controlled.

In addition, sub-frames 13 and 14 are vertically arranged on a base plate 12 that connects the side plates 1 and 2 and a transfer roller 15 is rotatably supported between the sub-frames 13 and 14.

A sub-scanning motor 17 is provided on the side of the sub-frame 14. A gear 18 fixed to the rotation axis of a sub-scanning motor 17 and a gear 19 fixed to the axis of the transfer roller 15 are provided to transmit the rotation of the sub-scanning motor 17 to the transfer roller 15.

Furthermore, a reliability maintaining and recovery mechanism 21 (hereinafter referred to as subsystem) for the recording head 6 is provided between the side plate 1 and the sub-frame 12.

The sub-system 21 is structured to have four capping devices 22 that cap the ejection surface of the recording head 6, a holder 23 that holds the capping devices 22, and a link member 24 that holds the holder 23 in order to swing back and forth.

When the carriage 5 moves in the main scanning direction and contacts an engagement portion 25 provided to the holder 23, the holder 23 is lift up to cap the ejection surface of the recording head 6 by the capping device 22.

When the carriage 5 moves onto the side of the print area, the holder 23 is lift down so that the capping device 22 moves away from the ejection surface of the recording head 6.

The capping device 22 is connected to a suction pump 27 via a suction tube 26, forms an air releasing opening mouth, and is communicated with atmosphere via an air releasing tube and an air releasing valve. The suction pump 27 discharges waste liquid (waste ink) to a waste liquid tank.

Furthermore, on the lateral side of the holder 23, a wiper blade 32 that wipes the ejection surface of the recording head 6 is attached to a blade arm 31. The blade arm 31 is pivotally supported to swing back and forth by the rotation of cams rotated by a driving device (not shown).

Structure Example of Printing Mechanism and Detection Mechanism of Recording Device Next, a structure example of this embodiment about the printing mechanism and the detection mechanism of the recording device is described with reference to FIG. 2.

Figure 2:
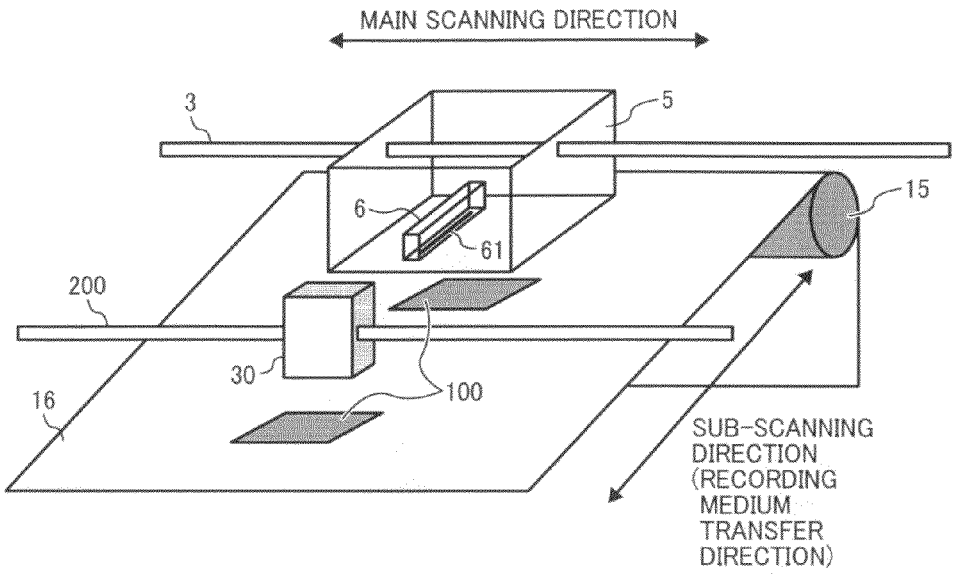
FIG. 2 is a schematic diagram illustrating a structure example of the printing mechanism and the detection mechanism of an embodiment of the recording device of the present disclosure.
Figure 3:
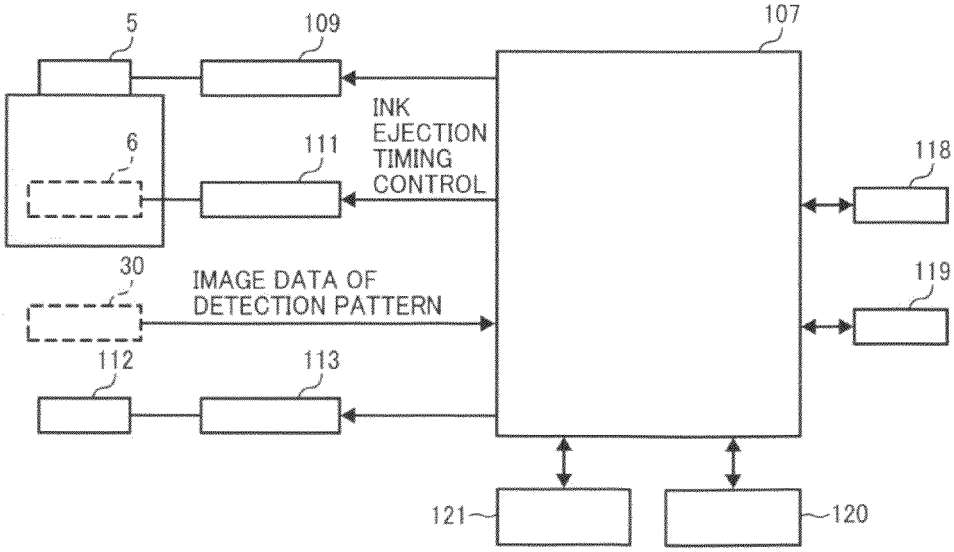
FIG. 3 is a diagram illustrating a structure example of the control mechanism of an embodiment of the recording device of the present disclosure.

The printing mechanism of the recording device of this embodiment is structured to have a carriage 5 and a main support guiding rod 3 as illustrated in FIG. 2.

The carriage 5 is structured to have the recording head 6.

The printing mechanism of this embodiment transfers the recording medium 16 in the sub-scanning direction while conducting scanning and moving the carriage 5 installed on the recording head illustrated in FIG. 2 in the main scanning direction. The printing mechanism ejects ink from the nozzle line 61 installed on the recording head 6 on the recording medium 16 according to the predetermined print timing signals to print dot images on the recording medium 16.

The printing mechanism of this embodiment conducts image formation by ink ejection when the recording medium 16 is transferred just below the recording head 6 by the rotation of the transfer roller 15.

The transfer amount of the recording medium 16 is controlled by the position data of A, B, and Z phases of an encoder (not shown) attached to the rotation axis (not shown) of the transfer roller 15.

In this embodiment, the reference positioning of the transfer roller 15 is made based on the Z phase and then misalignment detection processes described later start.

The detection mechanism of this embodiment is structured to have a guide rod 200 for two-dimensional sensor and the two-dimensional sensor 30 as illustrated in FIG. 2.

The detection mechanism of this embodiment is situated on the downstream side (transfer direction side of the recording medium 16) of the recording head 6.

The guide rod 200 for two-dimensional sensor supports the two-dimensional sensor 30.

The two-dimensional sensor 30 detects the detection pattern 100 formed on the recording medium 16 by the printing mechanism and obtains the image data of the detection pattern 100.

The detection pattern of this embodiment detects the detection pattern 100 formed on the recording medium 16 by the two-dimensional sensor 30 and a control unit (not shown) obtains image data of the detection pattern 100.

There is no specific limit to the selection of the structure of the two-dimensional sensor 30 and the detection method thereof and any known device and method can be suitably used as long as it detects the detection pattern 100.

In addition, there is no specific limit to the arrangement of the two-dimensional sensor 30 and any position is suitable as long as it detects the detection pattern 100.

For example, it is possible to structure and arrange the two-dimensional sensor 30 integrated with the recording head 6 in the carriage 5.

Structure Example of Control Mechanism of Recording Device

Next, a schematic structure example of the control mechanism of the recording device of this embodiment is described with reference to FIG. 3.

The control mechanism of the recording device in this embodiment includes a control unit 107, a main storage 118, a sub-storage 119, the carriage 5, a main scanning driver 109, the recording head 6, a recording head driver 111, the two-dimensional sensor 30, the paper transfer unit 112, the sub-scanning driver 113, an image processing unit 120, and an adjustment pattern generator 121.

The control unit 107 provides recorded data and driving control signals (pulse signals) to the main storage 118 and each driver to control the entire of the recording device.

The control unit 107 controls driving of the carriage 5 in the main scanning direction via the main scanning driver 109.

In addition, the control unit 107 controls ejection timing of the ink from the recording head 6 via the recording head driver 111.

The control unit 107 controls driving of the paper transfer unit 112 (e.g., transfer belt) in the sub-scanning direction via the sub-scanning driver 113.

The two-dimensional sensor 30 detects the detection pattern 100 formed on the recording medium 16 and outputs the image data of the detection pattern 100 to the control unit 107.

The main storage 118 stores necessary data. For example, programs such as procedures processed by the control unit 107 are stored.

The main storage 118 is rewritable from outside.

The sub-storage 119 is used as working memory, etc.

The control unit 107 of this embodiment reads image data from the image processing unit 120 according to the print mode and converts the read image data into image format for the recording head in the sub-storage 119.

The image data converted in the sub-storage 119 is transmitted to the recording head driver 111.

The recording head driver 111 generates various kinds of timing signals for driving heads according to the print mode and transfers the various kinds of timing signals and the image data to the recording head 6 for print processing.

In addition, the control unit 107 controls driving of the carriage 5 in the main scanning direction via the main scanning driver 109 according to the print mode and driving of the paper transfer unit 112 (such as transfer belt) in the sub-scanning direction via the sub-scanning driver 113 for print operation.

In addition, the control unit 107 transmits parameters for generating the detection pattern 100 to the adjustment pattern generator 121 when it detects misalignment. The adjustment pattern generator 121 generates the detection pattern 100 based on the parameters. The control unit 107 converts the detection pattern 100 generated by the adjustment pattern generator 121 into the image format for the recording head in the sub-storage 119 similarly to the case of the typical printing described above.

Then, the control unit 107 controls the main scanning driver 109, the carriage 5, the recording head driver 111, the recording head 6, the sub-scanning driver 113, the paper transfer unit 112, etc., and forms the detection pattern 100 on the recording medium 16 as in the case of the typical printing described above.

After formation of the detection pattern 100, the two-dimensional sensor 30 detects the detection pattern 100 and the image data of the detection pattern 100 obtained by detecting the detection pattern 100 is sequentially stored in the sub-storage 119.

The control unit 107 conducts two dimension frequency analysis such as two-dimension Fourier transform for the image data of the detection pattern 100 stored in the sub-storage 119 to obtain the frequency characteristics in the main scanning direction and the sub-scanning direction.

The control unit 107 determines misalignment in the main scanning direction and the sub-scanning direction from the difference between the frequency characteristics in the main scanning direction and the sub-scanning direction and predetermined reference frequency characteristics in the main scanning direction and the sub-scanning direction.

Structure Example of Detection Pattern 100

Next, structure examples of the detection pattern 100 ARE described with reference to FIG. 4.

Figure 4:
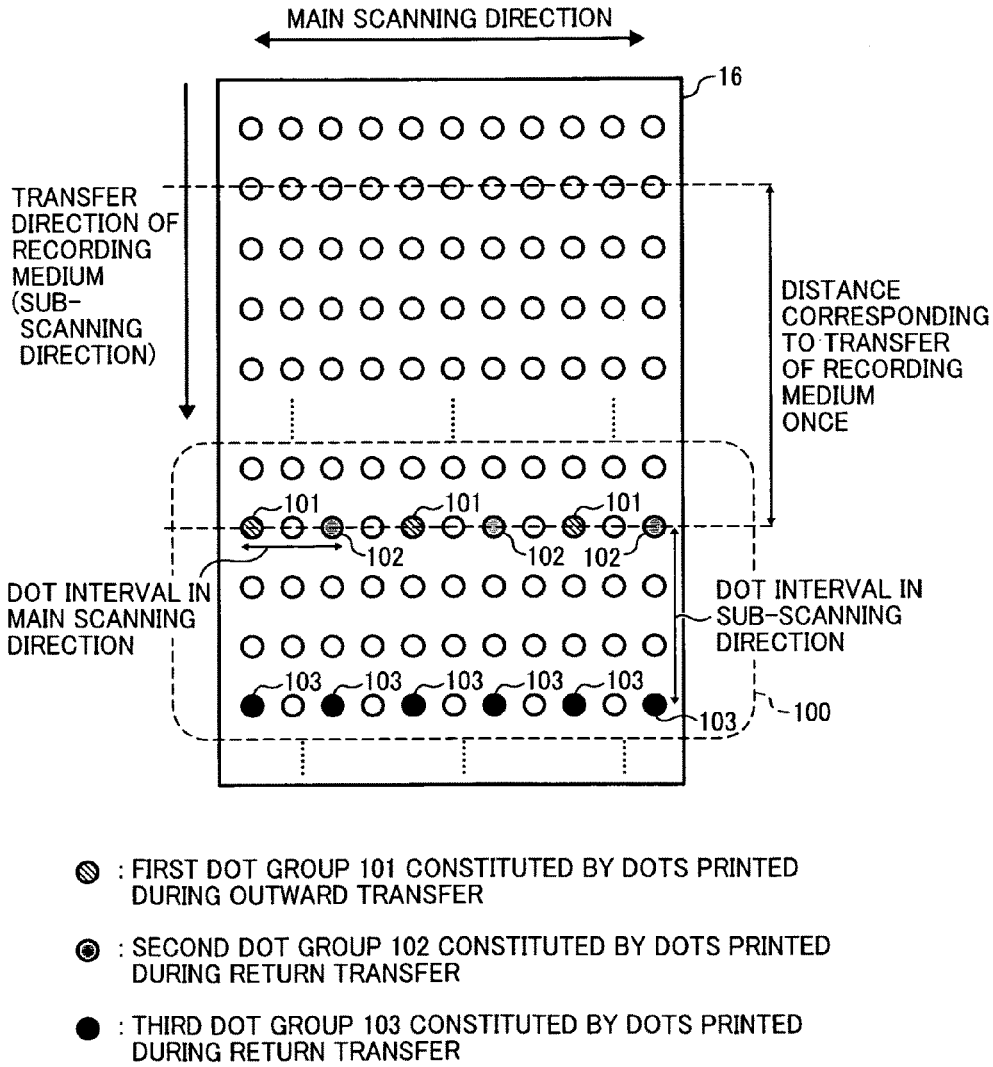
FIG. 4 is a diagram illustrating a structure example of a detection pattern 100 described later.

The detection pattern 100 is structured by the first dot group 101, the second dot group 102, and the third dot group 103 as illustrated in FIG. 4.

In this Embodiment, the dot group represents a group formed of multiple dots.

The first dot group 101 is formed of multiple dots printed on the recording medium 16 while the carriage 5 is moving outward to detect misalignment in the main scanning direction and the sub-scanning direction.

The second dot group 102 is formed of multiple dots printed on the recording medium 16 while the carriage 5 is returning after the recording medium on which the first group 101 is formed is transferred once. The second dot group 102 is used to detect misalignment in the main scanning direction.

The third dot group 103 is formed of multiple dots printed on the recording medium 16 at the same time when dots constituting the second dot group 102 are printed on the recording medium 16 (while the carriage 5 is returning). The third dot group 103 is used to detect misalignment in the sub-scanning direction.

The control unit 107 preliminarily inputs parameters to form the detection pattern 100 into the adjustment pattern generator 121 before forming the detection pattern 100 on the recording medium 16.

The control unit 107 can change the printing position of each dot forming the detection pattern 100, the dot distance in the main scanning direction, the dot distance in the sub-scanning direction, how many times dots are printed, etc. by changing parameters input into the adjustment pattern generator 121.

For example, the dot distance in the main scanning direction between the dot constituting the first dot group 101 and the dot constituting the second dot group 102 and the dot distance in the sub-scanning direction between the dot constituting the second dot group 102 and the dot constituting the third dot group 103 can be arbitrarily determined by the definition of the two-dimensional sensor 30, the kind of the recording medium 16 that forms the detection pattern 100.

The recording device of this embodiment detects the detection pattern 100 constituted by the first dot group 101, the second dot group 102, and the third dot group 103 illustrated in FIG. 4 with the two-dimension sensor 30 and obtains the image data of the detection pattern 100.

The image data of the obtained detection pattern 100 is two-dimension frequency analyzed and misalignment in the main scanning direction and the sub-scanning direction is detected based on the analysis result.

Formation Method Example of Detection Pattern 100

Next, how the detection pattern 100 is formed is described.

First, the reference position of the transfer roller 15 is adjusted using the Z phase of the encoder (not shown) attached to the transfer roller 15 to determine the roller reference position (initial position).

The roller reference position (initial position) is the starting position from which the detection pattern 100 is printed on the recording medium 16.

Figure 5:
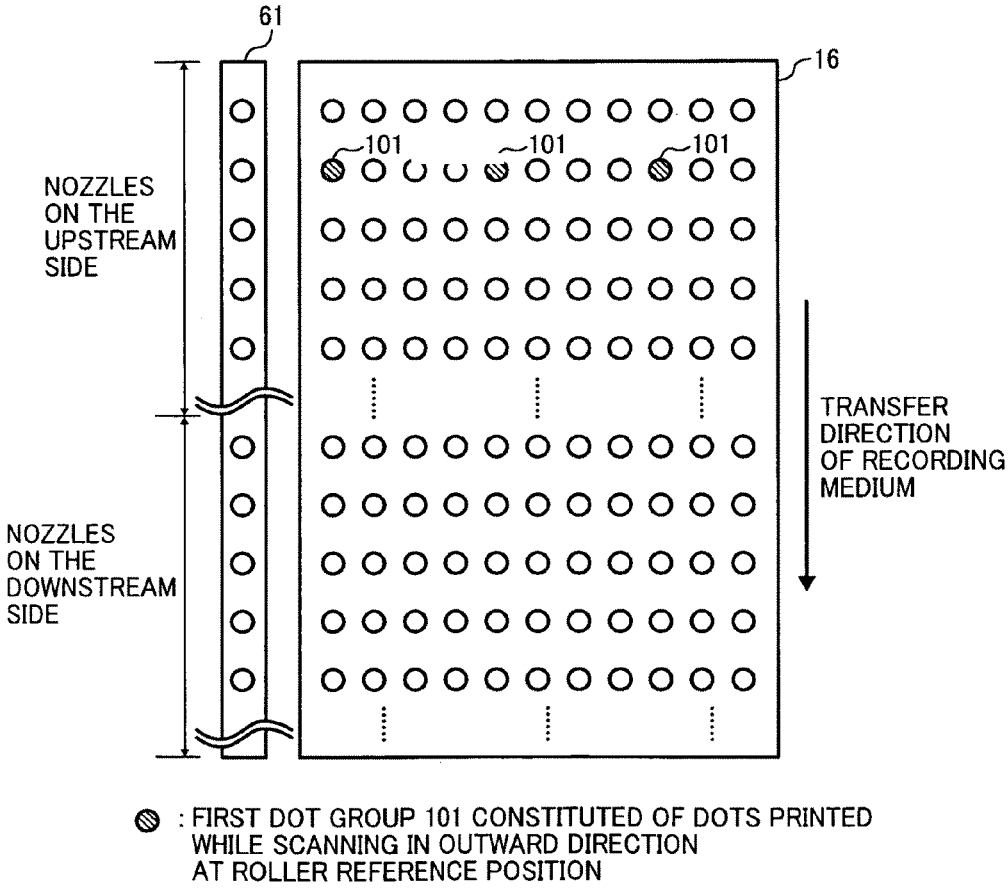
FIG. 5 is a first diagram illustrating an example of the method of forming the detection pattern 100.

After the roller reference position (initial position) is determined, dots constituting the first dot group 101 are printed on the recording medium 16 a constant distance apart between the dots using the nozzles situated on the upstream side among the nozzle line 61 relative to the transfer direction while moving the carriage 5 in the outward direction for scanning. Thus, the first dot group 101 illustrated in FIG. 5 is formed on the recording medium 16.

Next, the recording medium 16 is transferred from the roller reference position (initial position) in a distance corresponding to one transfer move of the transfer medium 16.

The distance corresponding to one transfer move of the transfer medium 16 is ideally a distance equal to or less than the length of the nozzle line 61 in the sub-scanning direction.

Therefore, when the recording medium 16 is ideally transferred one transfer move, dots constituting the second dot group 102 can be printed using nozzles situated on the downstream side in the nozzle line 61 relative to the transfer direction at the sub-scanning direction position of the recording medium 16 on which the first dot group 101 is formed.

After the recording medium 16 is transferred one transfer move, dots constituting the second dot group 102 are printed on the recording medium 16 at a predetermined timing using the nozzles situated on the downstream side among the nozzle line 61 relative to the transfer direction while moving the carriage 5 for scanning in the return direction. Thus, the second dot group 102 illustrated in FIG. 6 is formed on the recording medium 16.

Figure 6:
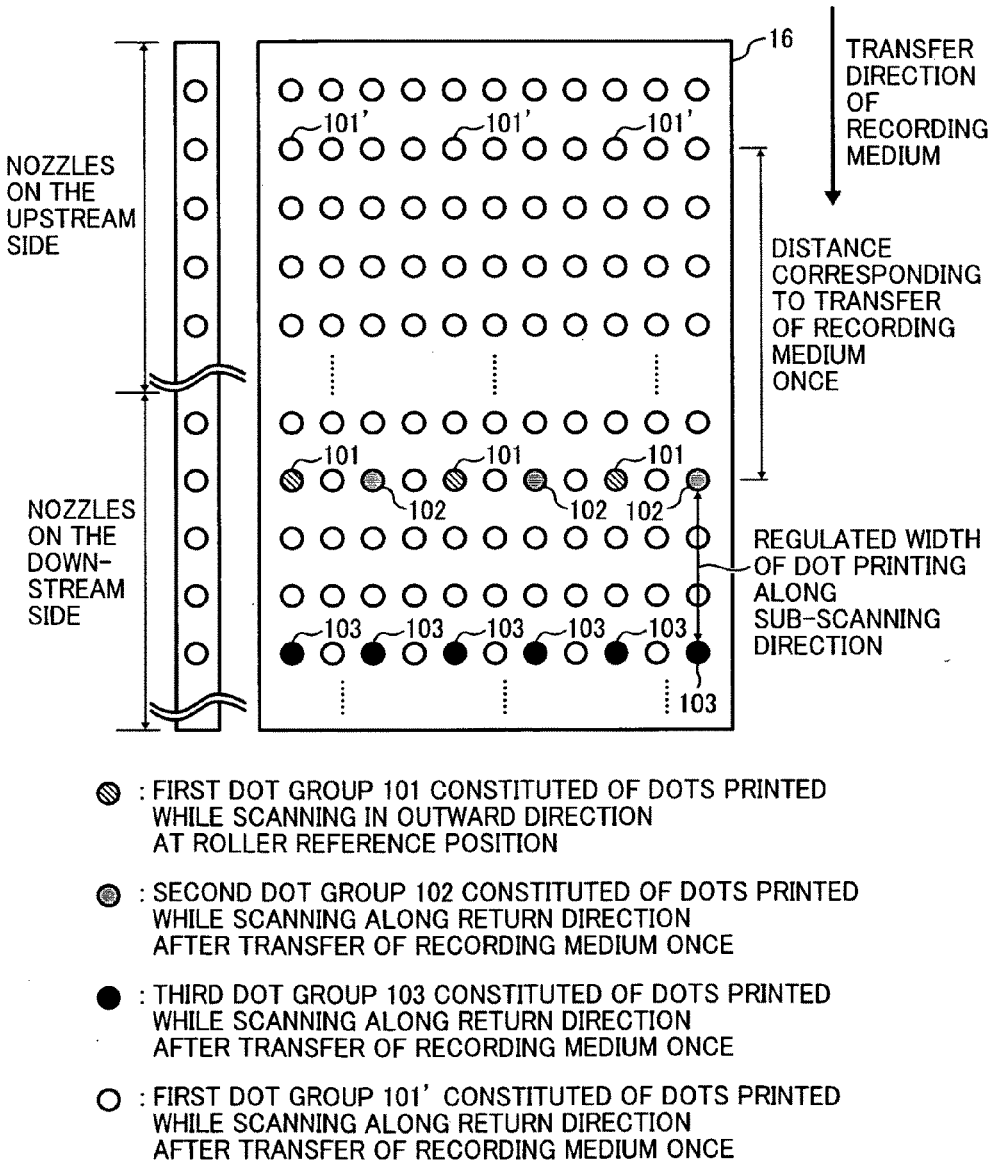
FIG. 6 is a second diagram illustrating an example of the method of forming the detection pattern 100.

The nozzles for use in forming the second dot group 102 are ideally the nozzles positioned at the place of the first dot group 101 formed on the recording medium 16 after the transfer as illustrated in FIG. 6.

The predetermined timing of printing dots constituting the second dot group 102 is ideally when the dots constituting the second dot group 102 are printed just between the dots constituting the first dot group 101.

That is, unless misalignment occurs in the main scanning direction, the ideal second dot group 102 can be formed on the recording medium 16 as illustrated in FIG. 6.

In addition, dots constituting the third dot group 103 are printed on the recording medium 16 at a predetermined timing using the nozzles situated with a distance corresponding to a regulated number of pixels (sub-scanning printing regulation width) away from the nozzles for forming the second dot group 102 in the sub-scanning direction as illustrated in FIG. 6.

The predetermined timing of printing dots constituting the third dot group 103 is ideally when the dots constituting the third dot group 103 are printed at the same position in the main scanning direction as those for the dots constituting the first dot group 101 and the dots constituting the second dot group 102.

That is, unless misalignment occurs in the main scanning direction and the sub-scanning direction, the ideal third dot group 103 can be formed on the recording medium 16 as illustrated in FIG. 6.

First dot group 101' illustrated on the upstream side in FIG. 6 is formed by printing dots constituting the first dot group 101' with a predetermined distance on the recording medium 16 using the nozzles on the upstream side when forming the second dot group 102 and the third dot group 103 using the nozzles on the downstream side.

In addition, second dot group 102' (not shown) and third dot group 103' (not shown) that constitute the detection pattern 100 together with the first dot group 101' are formed on the recording medium 16 using the nozzles situated on the downstream side after the transfer medium 16 on which the first dot group 101' is formed is transferred one transfer move.

That is, the recording device of this embodiment forms the first dot group 101 illustrated in FIG. 5 while moving the recording head outward and the second dot group 102 and the third dot group 103 illustrated in FIG. 6 while returning the recording head to form the detection pattern 100 constituted of the first dot group 101, the second dot group 102, and the third dot group 103 on the recording medium 16.

Analysis of Detection Pattern 100

Next, how the detection pattern 100 is analyzed is described.

The recording device of this embodiment detects the detection pattern 100 formed on the recording medium 16 by the two-dimensional sensor 30 and obtains image data of the detection pattern 100. Then, two dimension frequency analysis such as two-dimension Fourier transform is conducted for the image data of the detection pattern 100 to obtain the frequency characteristics in the main scanning direction (i.e., =frequency characteristics in the direction perpendicular to the transfer direction) and frequency characteristics in the sub-scanning direction (i.e., =frequency characteristics in the transfer direction).

The misalignment in the main scanning direction and the sub-scanning direction of printing dots can be detected from the difference between the obtained frequency characteristics in the main scanning direction and in the sub-scanning direction and predetermined reference frequency characteristics in the main scanning direction and the sub-scanning direction.

Unless misalignment occurs in the main scanning direction, the dots constituting the first dot group 101 and the dots constituting the second dot group 102 are printed in the recording medium a constant distance apart in the main scanning direction as illustrated in FIG. 6.

Unless misalignment occurs in the sub-scanning direction, the dots constituting the first dot group 101 and the dots constituting the third dot group 103 are printed in the recording medium away from each other with a distance corresponding to an amount of a regulated number of pixels (sub-scanning printing regulation width) in the sub-scanning direction as illustrated in FIG. 6.

However, if misalignment occurs in the main scanning direction, as illustrated in FIG. 7, the distance between the dots constituting the first group 101 formed when moving in the outward direction and the dots constituting the second group 102 formed when moving in the return direction is not constant so that the data obtained from the detection pattern 100 constituted of the first dot group 101, the second dot group 102, and the third dot group 103 contain misalignment component (main scanning printing misalignment component B1 and A1) in the main scanning direction.

In addition, if misalignment occurs in the sub-scanning direction, as illustrated in FIG. 7, the distance between the dots constituting the first group 101 formed before the recording medium 16 is transferred and the dots constituting the third group 103 formed after the recording medium 16 is transferred does not match the ideal distance of an amount of the regulated number of pixels so that the data obtained from the detection pattern 100 constituted of the first dot group 101, the second dot group 101, and the third dot group 102 contain misalignment component (eccentricity error component: transfer variation due to eccentricity) in the sub-scanning direction.

Misalignment in this embodiment is described about the case in which misalignment occurs at a unit of one pixel in the main scanning direction and the sub-scanning direction for simplicity.

However, misalignment of printing or eccentricity error of the transfer roller 15 equal to or less than one pixel can be detected by adjusting the accuracy of the two-dimensional sensor 30 and the dot constituting the detection pattern 100.

Figure 8A:
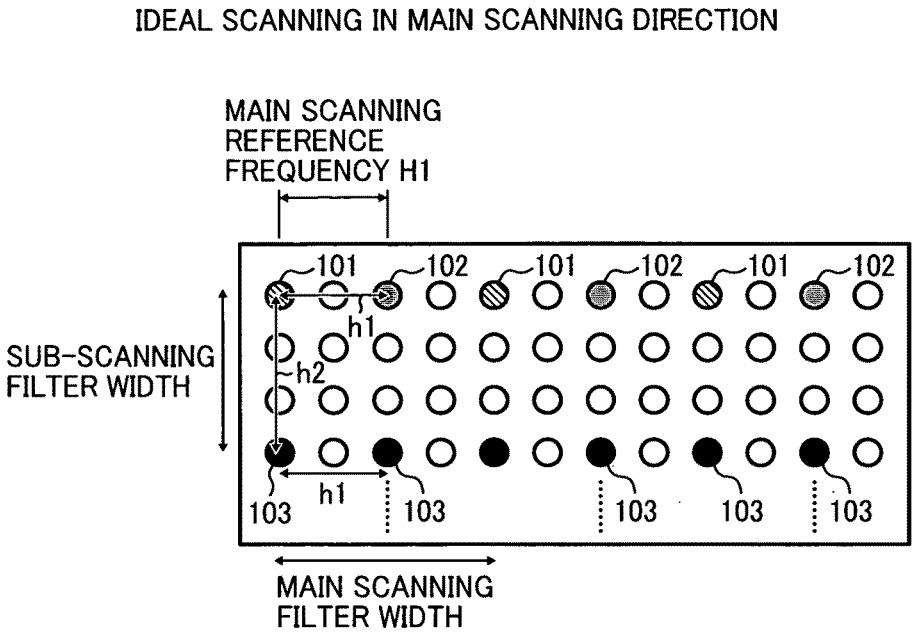
FIGS. 8A and 8B are diagrams illustrating the detection pattern 100 having no misalignment of dots along the main scanning direction and the sub-scanning direction.
Figure 8B:
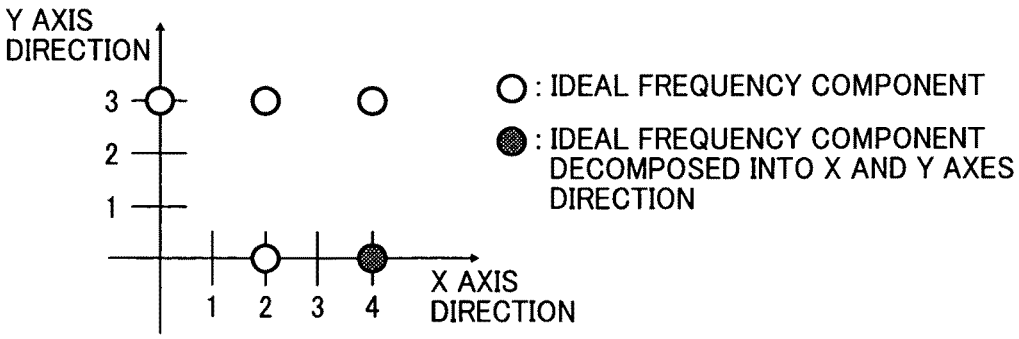

FIG. 8B is a diagram illustrating an example in which the detection pattern 100 free from misalignment in the main scanning direction and the sub-scanning direction illustrated in FIG. 8A is detected by the two-dimensional sensor 30, the image data of thus obtained detection pattern 100 are two dimension frequency analyzed, and position data for each dot constituting the detection pattern 100 are obtained.

In this embodiment, the position data illustrated in FIG. 8B are referred to as frequency component.

In this embodiment, since the regulated distance (dot distance in the main scanning direction illustrated in FIG. 4) between each dot in the main scanning direction constituting the detection pattern 100 is known in advance, the frequency component obtained from the dot distances greater than the regulated gap can be removed by filtration.

In addition, since the regulated gap (dot distance in the sub-scanning direction illustrated in FIG. 4) between each dot in the sub-scanning direction constituting the detection pattern 100 is known in advance, the frequency component obtained from the dot distances greater than the regulated gap can be removed by filtration.

The frequency component to be analyzed is limited to the first quadrant.

As a result, as illustrated in FIG. 8B, the pixel distance of the detection pattern 100 in the main scanning direction appears on the X axis and the pixel distance of the detection pattern 100 in the sub-scanning direction appears on the Y axis In the recording device of this embodiment, if printing is conducted in the main scanning direction according to the optimal print timing during the return and outward movement of the carriage 5, the first dot group 101 and the second dot group 102 printed during the return and outward movement are printed in the main scanning direction with a constant distance h1 apart as illustrated in FIG. 8A.

Figure 9:
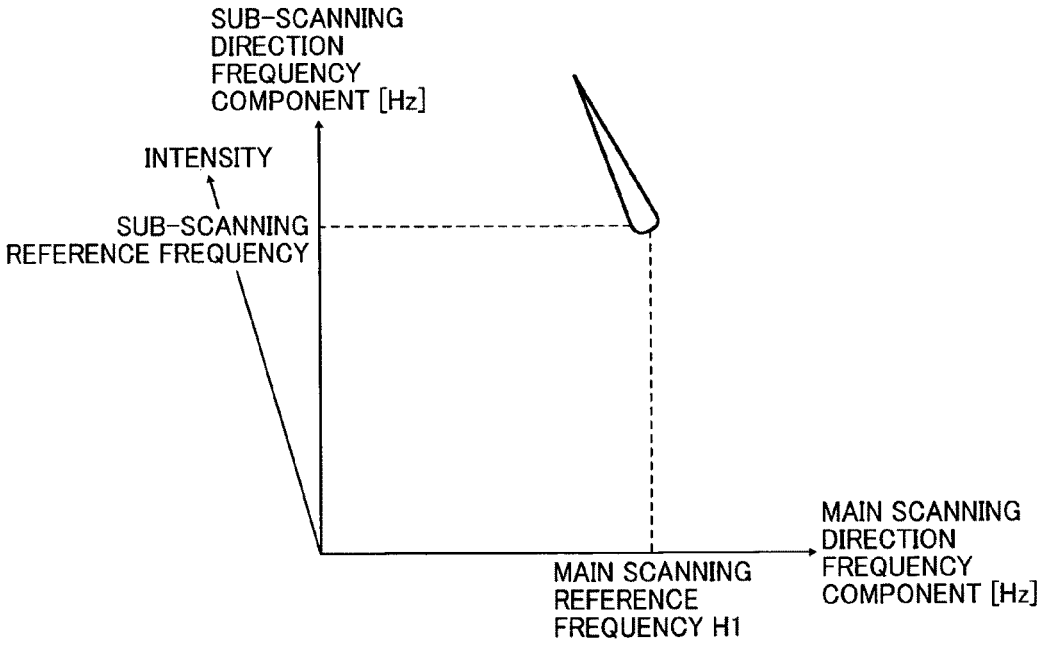
FIG. 9 is a diagram illustrating a reference frequency H1 described later in the main scanning direction.

When the first dot group 101 and the second dot group 102 illustrated in FIG. 8A are detected by the two-dimensional sensor 30 and the thus obtained image data are two-dimension frequency analyzed, the reference frequency characteristics in the main scanning direction are obtained as illustrated in FIG. 9.

As in the case of the first dot group 101 and the second dot group 102 illustrated in FIG. 8A, if the dots constituting the second dot group 102 are printed at the center between the dots constituting the first dot group 101, the dots constituting the second dot group 102 and the dots constituting the first dot group 101 are not superimposed but arranged with the constant distance h1 apart.

The reference frequency H1 in the main scanning direction represents the frequency component obtained when the dots constituting the second dot group 102 are printed at the center between the dots constituting the first dot group 101 and the distance between the dots constituting the second dot group 102 and the dots constituting the first dot group 101 is h1 as illustrated in FIG. 8A.

Since the third dot group 103 is formed by printing with a dot distance of h1, when the third dot group 103 is detected by the two-dimensional sensor 30 and the obtained image data are analyzed by two dimension frequency, the reference frequency characteristics in the main scanning direction are obtained as illustrated in FIG. 9.

Figure 10A:
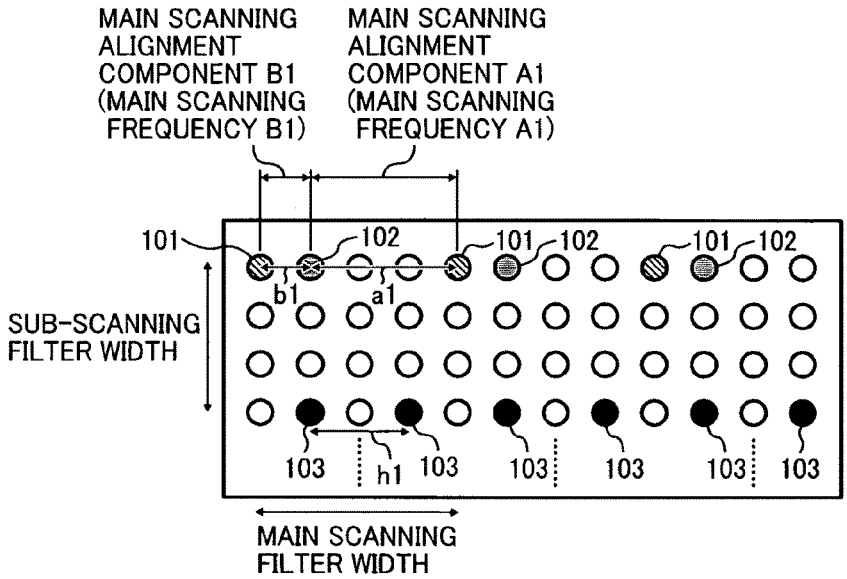
FIGS. 10A and 10B are diagrams illustrating the detection pattern 100 having misalignment of dots along the main scanning direction.
Figure 10B:
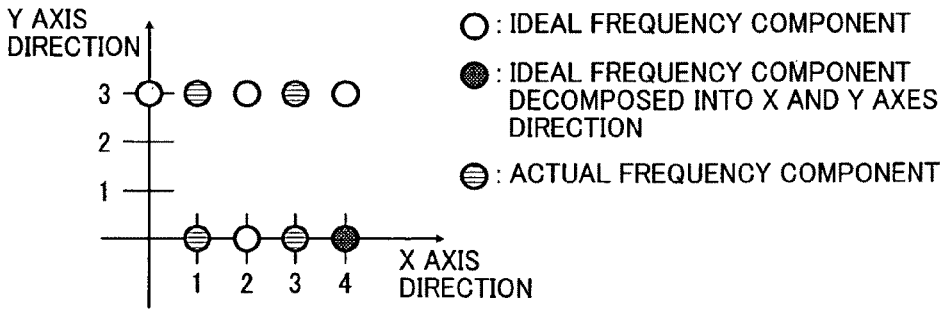

FIG. 10B is a diagram illustrating an example in which the detection pattern 100 with misalignment in the main scanning direction illustrated in FIG. 10A is detected by the two-dimensional sensor 30, the image data of thus obtained detection pattern 100 are two-dimension frequency analyzed, and position data for each dot constituting the detection pattern 100 are obtained.

FIG. 10A is a diagram illustrating a structure example of the detection pattern 100 when misalignment occurs in the main scanning direction. FIG. 10B is a diagram illustrating the position data (frequency component) obtained from the detection pattern 100 illustrated in FIG. 10A.

The frequency component on the X axis illustrated in FIG. 10B contains a frequency component different from the frequency component (=frequency component obtained in the ideal state) obtained from the regulated distance (ideal distance) in the main scanning direction between each dot constituting the detection pattern 100.

That is, a frequency component is present which is different from the frequency component for the reference frequency in the main scanning direction.

Therefore, misalignment in the main scanning direction is perceived.

In addition, the frequency component on the Y axis illustrated in FIG. 10B contains only the frequency component (=frequency component obtained in the ideal state) obtained from the regulated distance (ideal distance) in the sub-scanning direction between each dot constituting the detection pattern 100.

That is, only the frequency component is present by which the reference frequency in the sub-scanning direction is obtained.

Therefore, it is found that no misalignment occurs in the sub-scanning direction.

Due to the misalignment in the main scanning direction of dots constituting the second dot group 102 printed while the carriage is returning, when misalignment occurs in the main scanning direction as illustrated in FIG. 10A, the dots constituting the first dot group 101 and the dots constituting the second dot group 102 are not printed a constant distance apart in the main scanning direction. That is, as illustrated in FIG. 10A, the dots constituting the first dot group 101 printed while the carriage is moving outward and the dots constituting the second dot group 102 printed while the carriage is returning are printed with a narrower or wider distance than the ideal distance.

Therefore, the dot distance between the first dot group 101 and the dots constituting the second dot group 102 is not constant so that two dot distances of a1 and b1 appear.

Figure 11:
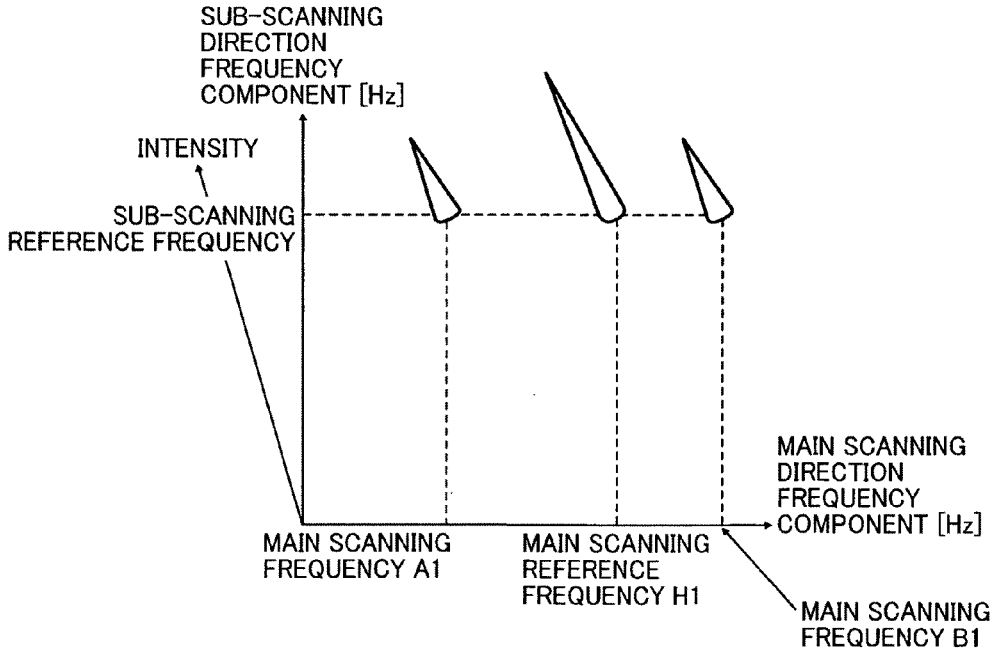
FIG. 11 is a diagram illustrating the frequency components (A1, B1) in the main scanning direction when misalignment occurs.

When the first dot group 101 and the second dot group 102 illustrated in FIG. 10A are detected by the two-dimensional sensor 30 and the thus obtained image data are two dimension frequency analyzed, two frequency components A1 and B1 different from the reference frequency H1 in the main scanning direction are obtained as illustrated in FIG. 11.

Therefore, misalignment in the main scanning direction can be detected based on the difference calculated by comparing the frequency components A1 and B1 in the main scanning direction with the reference frequency H1 in the main scanning direction.

For example, unless misalignment occurs in the main scanning direction, when the reference frequency H1 in the main scanning direction is obtained, the difference is zero. Therefore, it can be detected that no misalignment in the main scanning direction occurs.

In addition, if misalignment occurs in the main scanning direction, the frequency components A1 and B1 in the main scanning direction are obtained and thus the difference is obtained. Therefore, it can be detected that misalignment in the main scanning direction occurs.

As illustrated in FIG. 6, the recording device of this embodiment prints the dots constituting the second dot group 102 in the center with regard to the main scanning direction between the dots constituting the first dot group 101 so as to avoid overlapping of the dots constituting the second dot group 102 and the dots constituting the first dot group 101 in the main scanning direction.

Therefore, the frequency analysis in the main scanning direction becomes easy.

Figure 12:
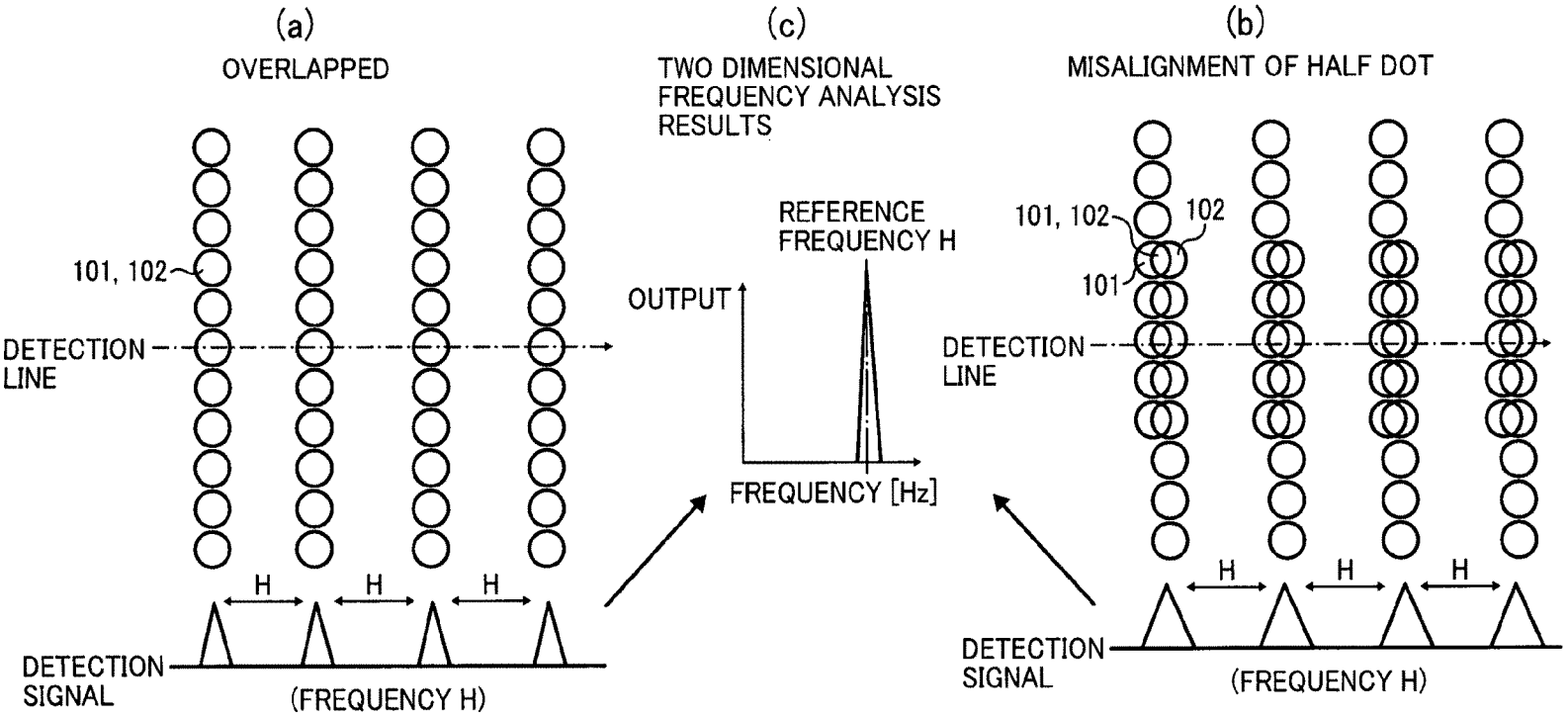
FIGS. 12A, 12B and 12C are diagrams illustrating the frequency component in the main scanning direction when misalignment occurs.

For example, as illustrated in FIG. 12A, when the dots constituting the first dot group 101 and the dots constituting the second dot group 102 are superimposed in the main scanning direction, the image data obtained from the first dot group 101 and second dot group 102 are a waveform having a constant cycle with a frequency H as illustrated in FIG. 12A and the output of the reference frequency H is high in the outputs of the two dimension frequency analysis results as illustrated in FIG. 12C.

In addition, as illustrated in FIG. 12B, when the dots constituting the first dot group 101 and the dots constituting the second dot group 102 are misaligned with a half dot in the main scanning direction, a phenomenon that the line (pattern) becomes thick occurs.

Therefore, the image data obtained from the first dot group 101 and the second dot group 102 have a waveform having a wide breadth as illustrated in FIG. 12B.

When the image data having a waveform having a wide breadth is frequency analyzed, the reference frequency is calculated based on, for example, the median of the image data or the edge (initial position) thereof.

According to the this approach, the cycle of the waveform is the same (frequency H) as those of the first dot group 101 and the second dot group 102 as illustrated in FIG. 12A. Therefore, the output of the reference frequency H is high in the outputs of the two dimension frequency analysis results as illustrated in FIG. 12C.

When the detection pattern 100 in which the dots constituting the first dot group 101 and the dots constituting the second dot group 102 are superimposed is formed and misalignment with a less than one dot occurs, the line formed of the first dot group 101 and the second dot group 102 becomes thick as illustrated in FIG. 12B.

However, if the line (pattern) formed of the first dot group 101 and the second dot group 102 becomes thick, since the cycle of the first dot group 101 and the second dot group 102 remains unchanged, the cycle of the waveform is the same (frequency H) as in the first dot group 101 and the second dot group 102 illustrated in FIG. 12A.

When the detection pattern 100 in which the dots constituting the first dot group 101 overlaps with the dots constituting the second dot group 102 is formed, accurate detection of misalignment may be difficult in some cases.

Therefore, in this embodiment, as illustrated in FIG. 6, the dots constituting the second dot group 102 are printed in the center with regard to the main scanning direction between the dots constituting the first dot group 101 so as to avoid overlapping of the dots constituting the second dot group 102 and the dots constituting the first dot group 101 in the main scanning direction.

Therefore, the phenomenon that the line (pattern) formed of the first dot group 101 and the second dot group 102 becomes thick does not occur.

Therefore, the embodiment is free from the problems described above and thus misalignment is easily and correctly detected.

Figure 13A:
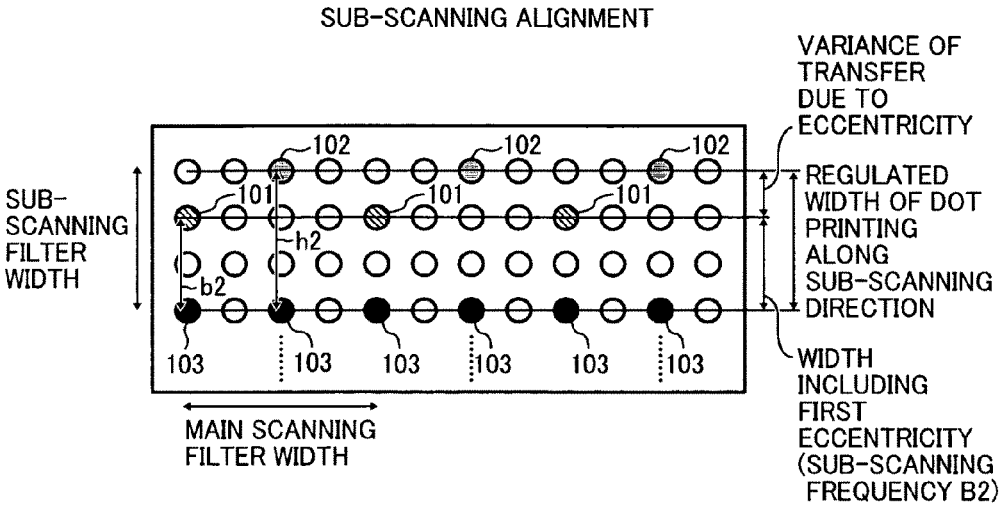
FIGS. 13A and 13B are diagrams illustrating the detection pattern 100 having misalignment of dots along the sub-scanning direction.
Figure 13B:
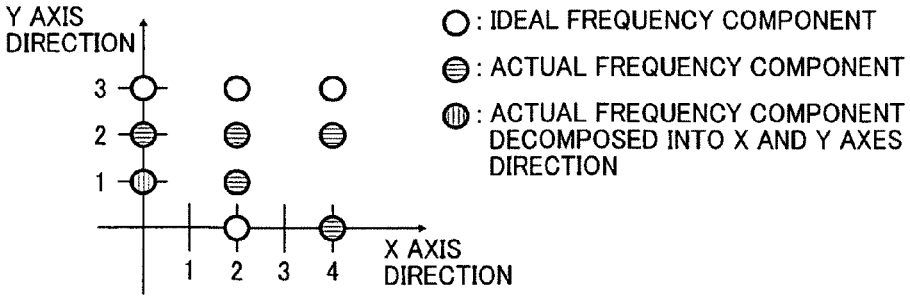

FIG. 13B is a diagram illustrating an example in which the detection pattern 100 having misalignment in the sub-scanning direction illustrated in FIG. 13A is detected by the two-dimensional sensor 30, the image data of thus obtained detection pattern 100 are two dimension frequency analyzed, and position data for each dot constituting the detection pattern 100 are obtained.

FIG. 13A is a diagram illustrating a structure example of the detection pattern 100 when misalignment occurs in the main scanning direction. FIG. 13B is a diagram illustrating the position data (frequency component) obtained from the detection pattern 100 illustrated in FIG. 13A.

The frequency component on the X axis illustrated in FIG. 13B contains only the frequency component (=frequency component obtained in the ideal state) obtained from the regulated distance (ideal distance) in the main scanning direction between each dot constituting the detection pattern 100.

That is, only the frequency component is present by which the reference frequency in the main scanning direction is obtained.

Therefore, it is found that no misalignment occurs in the sub-scanning direction.

However, the frequency component on the Y axis illustrated in FIG. 13B contains a frequency component different from the frequency component (=frequency component obtained in the ideal state) obtained from the regulated distance (ideal distance) in the sub-scanning direction between each dot constituting the detection pattern 100. That is, a frequency component is present which is different from the frequency component for the reference frequency in the sub-scanning direction. Therefore, misalignment in the main scanning direction is perceived.

With regard to the sub-scanning direction, if eccentricity error of the transfer roller 15 does not exist and no misalignment occurs in the sub-scanning direction, dots are printed a constant distance apart in the sub-scanning direction.

Figure 14:
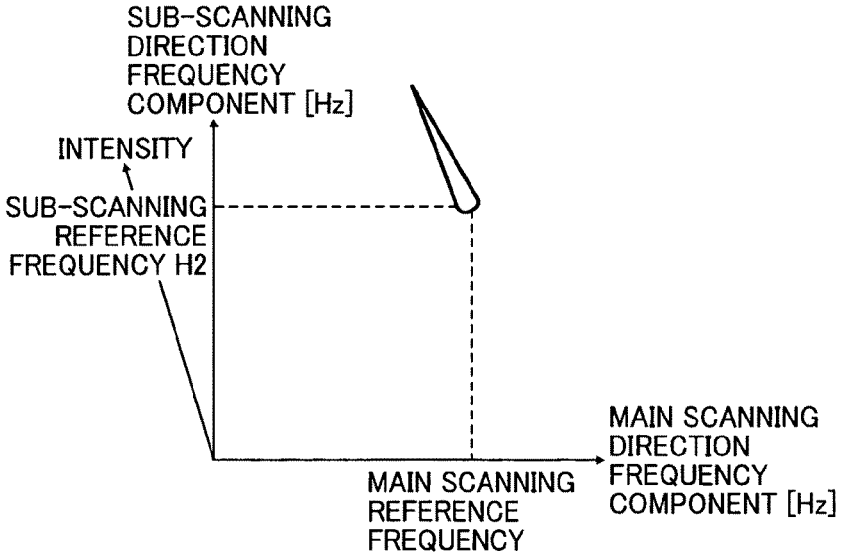
FIG. 14 is a diagram illustrating a reference frequency H2 described later in the sub-scanning direction.

When the first dot group 101 and the third dot group 103 illustrated in FIG. 8A are detected by the two-dimension sensor 30 and the thus obtained image data are two dimension frequency analyzed, the reference frequency characteristics in the sub-scanning direction are obtained as illustrated in FIG. 14.

As in the case of the first dot group 101, the second dot group 102, and the third dot group 103 illustrated in FIG. 8A, if the dots are printed a constant distance apart in the sub-scanning direction, the dots are not superimposed but arranged with a constant distance of h2.

The reference frequency H2 in the sub-scanning direction is obtained when the distance between the dots printed in the sub-scanning direction is h2 as illustrated in FIG. 8A.

In addition, since the second dot group 102 and the third dot group 103 are printed with a sub-scanning printing regulation width h2, when the second dot group 102 and the third dot group 103 are detected by the two-dimensional sensor 30 and the thus obtained image data are two dimension frequency analyzed, the reference frequency characteristics in the sub-scanning direction are obtained as illustrated in FIG. 14.

If eccentricity error of the transfer roller 15 exists and misalignment occurs in the sub-scanning direction, the dots constituting the first dot group 101, the second dot group 102, and the third dot group 103 are not printed a constant distance apart in the sub-scanning direction, but the distance b2 between the dots constituting the first dot group 101 and the third dot group 103 does not match the distance h2 between the dots constituting the second dot group 102 and the third dot group 103.

Figure 15:
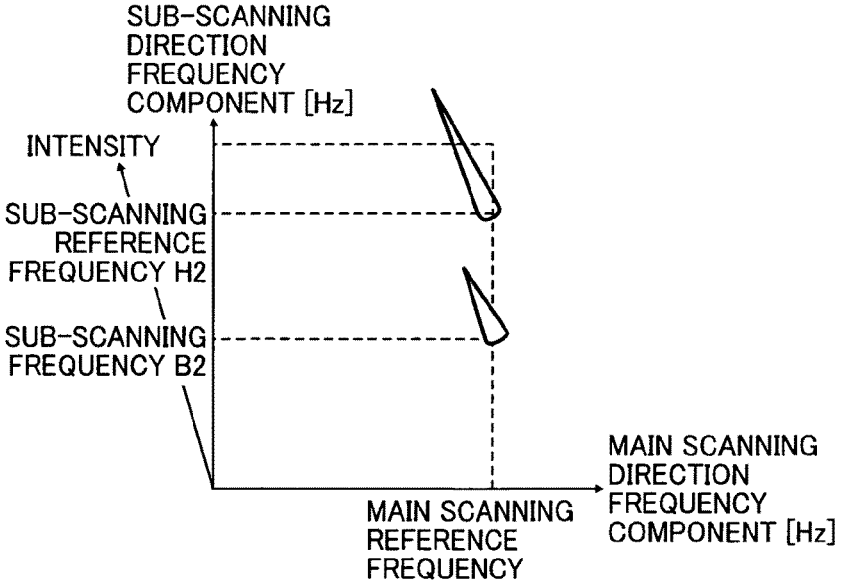
FIG. 15 is a diagram illustrating the frequency component (B2) in the sub-scanning direction when misalignment occurs.

Therefore, the distance between the dots printed in the sub-scanning direction is not constant but two distances b2 and h2 appear. When the first dot group 101, the second dot group 102, and the third dot group 103 illustrated in FIG. 13A are detected by the two-dimensional sensor 30 and the thus obtained image data are two dimension frequency analyzed, a frequency component B2 different from the reference frequency characteristics H2 in the sub-scanning direction is obtained as illustrated in FIG. 15.

Therefore, misalignment of printing in the sub-scanning direction can be detected by calculating the difference obtained by comparing the frequency component B2 in the sub-scanning direction with the reference frequency H2 in the sub-scanning direction.

For example, unless misalignment occurs in the sub-scanning direction, when the reference frequency H2 in the sub-scanning direction is obtained, the difference is zero. Therefore, it can be detected that no misalignment in the sub-scanning direction occurs.

In addition, if misalignment occurs in the sub-scanning direction, the frequency component B2 in the sub-scanning direction are obtained and thus the difference is obtained.

Therefore, it can be detected that misalignment in the sub-scanning direction occurs.

Figure 16A:
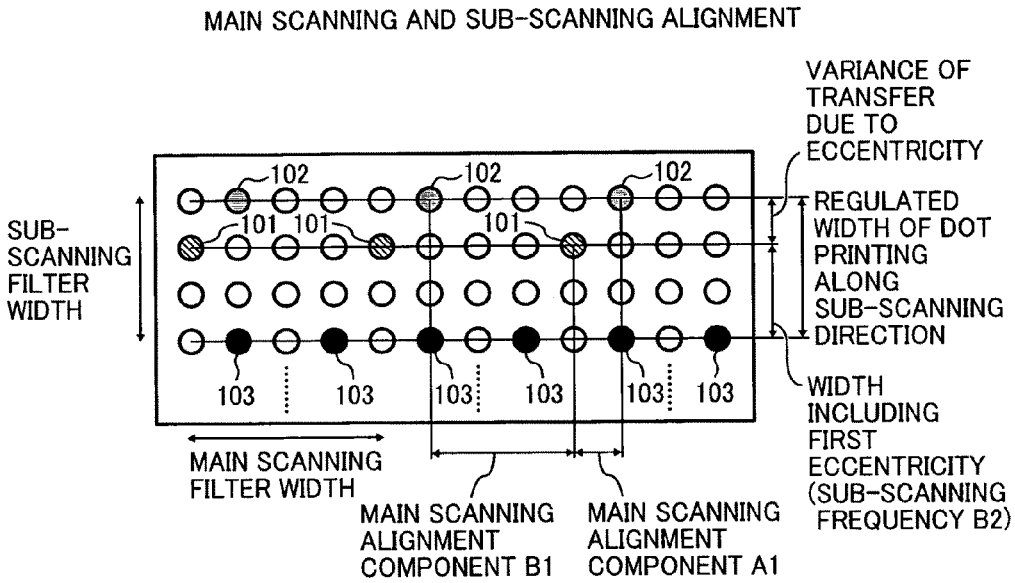
FIGS. 16A and 16B are diagrams illustrating the detection pattern 100 having misalignment of dots along the main scanning direction and the sub-scanning direction.
Figure 16B:
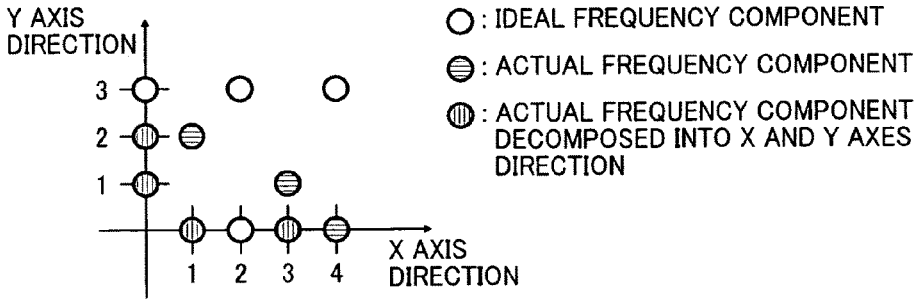

FIG. 16B is a diagram illustrating an example in which the detection pattern 100 having misalignment in the main scanning direction and the sub-scanning direction illustrated in FIG. 16A is detected by the two-dimensional sensor 30, the image data of the thus obtained detection pattern 100 are two dimension frequency analyzed, and position data for each dot constituting the detection pattern 100 are obtained. FIG. 16A is a diagram illustrating a structure example of the detection pattern 100 when misalignment occurs in the main scanning direction and the sub-scanning direction. FIG. 16B is a diagram illustrating the position data (frequency component) obtained from the detection pattern 100 illustrated in FIG. 16A.

The frequency component on the X axis illustrated in FIG. 16B contains a frequency component different from the frequency component (=frequency component obtained in the ideal state) obtained from the regulated gap (ideal gap) in the main scanning direction between each dot constituting the detection pattern 100. That is, a frequency component is present which is different from the frequency component for the reference frequency in the main scanning direction. Therefore, misalignment in the main scanning direction is perceived.

In addition, the frequency component on the Y axis illustrated in FIG. 16B contains a frequency component different from the frequency component (=frequency component obtained in the ideal state) obtained from the regulated distance (ideal distance) in the sub-scanning direction between each dot constituting the detection pattern 100. That is, a frequency component is present which is different from the frequency component for the reference frequency in the sub-scanning direction. Therefore, misalignment in the main scanning direction is perceived.

When misalignment occurs in the main scanning direction and the sub-scanning direction at the same time, dots are not printed a constant distance apart in the main scanning direction or the sub-scanning direction. In fact, as illustrated in FIG. 16A, the first dot group 101, the second dot group 102, and the third dot group 103 that form the detection pattern 100 are printed with a narrower or wider distance than the ideal distances in the main scanning direction and the sub-scanning direction.

Figure 17:
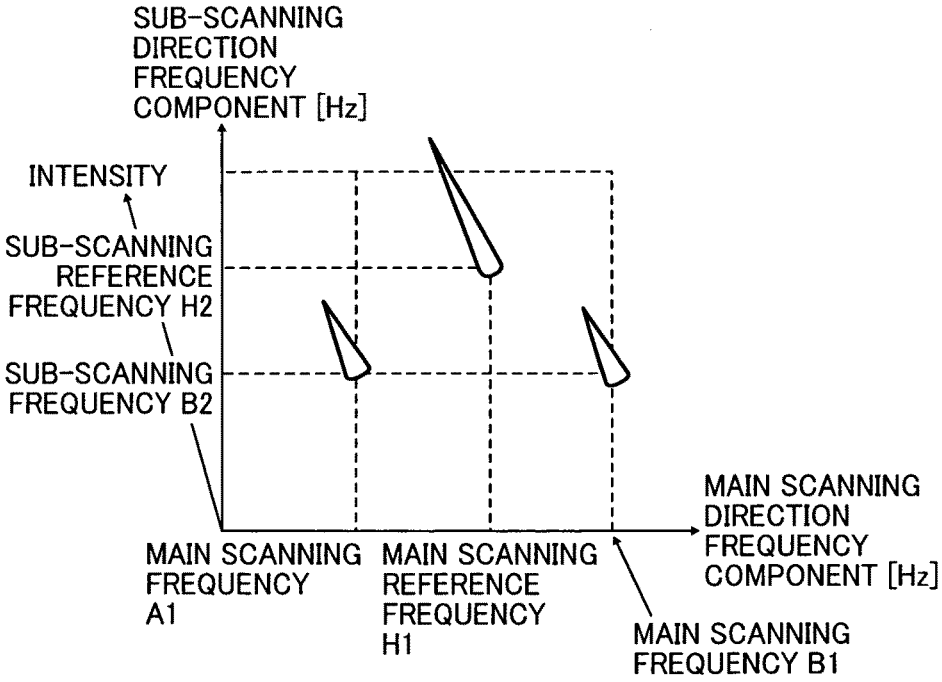
FIG. 17 is a diagram illustrating the frequency components (A1, B1, B2) in the main scanning direction and the sub-scanning direction when misalignment occurs.
Figure 18:
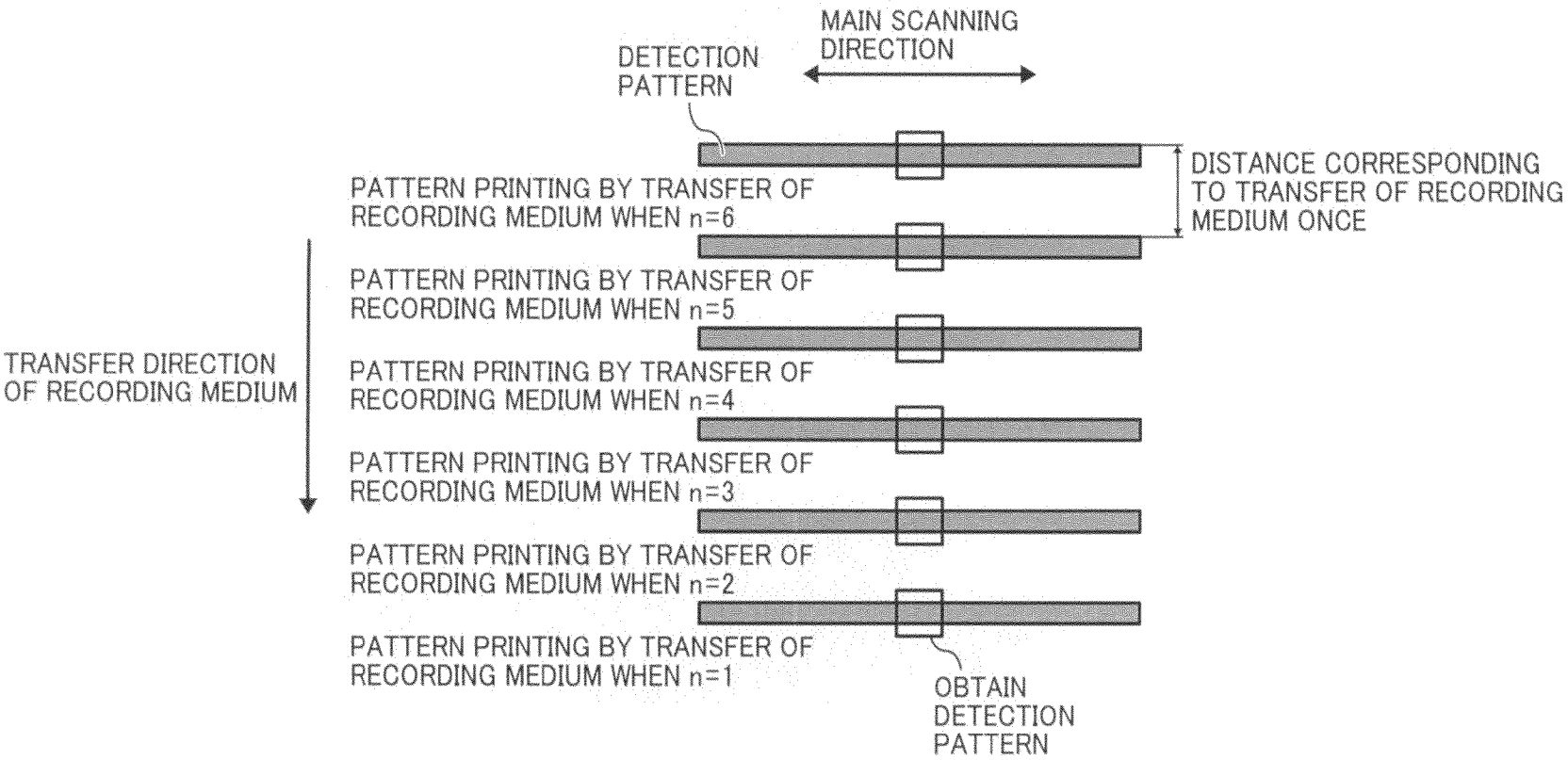
FIG. 18 is a diagram illustrating an example of the method of forming the detection pattern 100.

When the detection pattern 100 illustrated in FIG. 16A is detected by the two-dimensional sensor 30 and the thus obtained image data are two dimension frequency analyzed, frequency components different from the reference frequency characteristics appear in each of the main scanning direction and the sub-scanning direction and thus three different frequency components A1, A2, and B2 are obtained as illustrated in FIG. 17.

Therefore, misalignment in the main scanning direction and the sub-scanning direction can be detected by calculating the difference obtained by comparing the frequency components A1, B1, and B2 in the main scanning direction and the sub-scanning direction with the reference frequencies H1 and H2 in the main scanning direction and the sub-scanning direction.

Misalignment in the main scanning direction can be adjusted by adjusting the print timing signals while the recording head is return based on the difference obtained by comparing the two frequency components A1 and B1 in the main scanning direction obtained when misalignment occurs with the predetermined reference frequency H1 in the main scanning direction.

That is, misalignment in the main scanning direction can be adjusted by adjusting the print timing while the recording head is returning based on the difference obtained by comparing the frequency components A1 and B1 in the main scanning direction obtained from the first dot group 101 and the second dot group 102 with the predetermined reference frequency H1 in the main scanning direction.

In addition, since the same frequency component as the reference frequency H1 is obtained from the third dot group 103, the frequency component H1 obtained from the third dot group 103 can be also used for comparison.

The frequency component obtained from the third dot group 103 constitutes the largest component when misalignment occurs.

Therefore, the frequency component can be identified.

Therefore, misalignment in the main scanning direction can be adjusted by, for example, adjusting the print timing while the recording head is returning based on the difference obtained by comparing the frequency components A1 and B1 in the main scanning direction obtained from the first dot group 101 and the second dot group 102 with the frequency component H1 in the main scanning direction obtained from the third dot group 103.

Additionally, misalignment in the sub-scanning direction can be adjusted by, for example, adjusting the transfer distance by the transfer roller 15 based on the difference obtained by comparing the frequency component B2 in the sub-scanning direction obtained when misalignment occurs with the predetermined reference frequency H2 in the sub-scanning direction.

That is, misalignment in the sub-scanning direction can be adjusted by adjusting the transfer distance (amount) by the transfer roller 15 based on the difference obtained by comparing the frequency component B2 in the sub-scanning direction obtained from the first dot group 101 and the third dot group 103 with the predetermined reference frequency H2 in the sub-scanning direction.

In addition, since the same frequency component as the reference frequency H2 is obtained from the second dot group 102 and the third dot group 103, the frequency component H2 obtained from the second dot group 102 and the third dot group 103 can be also used for comparison.

The frequency component obtained from the second dot group 102 and the third dot group 103 constitutes the largest component when misalignment occurs. Therefore, the frequency component can be identified.

Therefore, misalignment in the sub-scanning direction can be adjusted by adjusting the transfer distance (amount) by the transfer roller 15 based on the difference obtained by comparing the frequency component B2 in the sub-scanning direction obtained from the first dot group 101 and the third dot group 103 with the frequency component H2 in the sub-scanning direction obtained from the second dot group 102 and the third dot group 103.

As described above, the recording device of the present disclosure forms the detection pattern 100 constituted of the first dot group 101, the second dot group 102, and the third dot group 103 on the recording medium 16.

The detection pattern 100 formed on the recording medium 16 is detected by the two-dimensional sensor 30 to obtain the image data of the detection pattern 100. The thus obtained image data are—two dimension frequency analyzed, and position data for each dot constituting the detection pattern 100 are obtained.

Therefore, misalignment in the main scanning direction and misalignment in the sub-scanning direction are detected simultaneously so that the misalignment in the main scanning direction and the misalignment in the sub-scanning direction can be adjusted.

To obtain the correction data for one transfer unit corresponding to one roll of the transfer roller 18, the detection patterns 100 are formed on the recording medium 100 for the number of transfer units (n=1 to N) required to rotate one roll of the transfer roller 15 and each detection pattern 100 for each transfer amount is detected by the two-dimensional sensor 30 to detect the misalignment in the main scanning direction and the misalignment in the sub-scanning direction.

n represents the number of transfer times by the transfer roller 15 and N represents the number of transfer times by the transfer roller 15 when the transfer roller 15 rotates one roll.

Thereby, the difference between the ideal transfer amount and the actual transfer amount in the sub-scanning direction for each transfer unit is obtained as misalignment component of printing in the sub-scanning direction and eccentricity data for one roll of the transfer roller 15 can be obtained.

Furthermore, since the misalignment components of printing in the main scanning direction can be obtained multiple times, the accuracy of the misalignment component of printing in the main scanning direction is improved by averaging the thus obtained misalignment components The recording device of the present disclosure stores the thus obtained misalignment component of printing in the main scanning direction and the thus obtained misalignment component of printing in the sub-scanning direction in the sub-storage 119 and the misalignment component in the main scanning direction and the sub-scanning direction are adjusted based on the misalignment component stored in the sub-storage 119.

To be specific, the difference between the frequency components A1 and B1 in the main scanning direction obtained from the first dot group 101 and the second dot group 102 and the predetermined reference frequency H1 in the main scanning direction is obtained with regard to the main scanning direction to calculate the correction value for adjusting the print timing for return printing.

Then, according to the correction value, the print timing signal is corrected for return printing and corrected print timing signal is stored in the sub-storage 119.

Then, using the corrected print timing signal for return printing stored in the sub-storage 119, the misalignment in the main scanning direction is adjusted.

Additionally, misalignment in the main scanning direction can be adjusted by adjusting the print timing while the recording head is returning based on the difference obtained by comparing the frequency components A1 and B1 in the main scanning direction obtained from the first dot group 101 and the second dot group 102 with the frequency component H1 in the main scanning direction obtained from the third dot group 103.

Additionally, the misalignment amount for each transfer amount unit in the sub-scanning direction is calculated by obtaining the difference obtained by comparing the frequency component B2 in the sub-scanning direction obtained from the first dot group 101 and the third dot group 103 with the predetermined reference frequency H2 in the sub-scanning direction.

Thereafter, based on the misalignment amount for each transfer unit, the correction value for each transfer unit is calculated. The corrected values calculated for each transfer unit are reflected in the transfer amount of the transfer unit by the transfer roller 15 set by printing before this correction and the transfer amounts after eccentricity correction are calculated. These transfer amounts after eccentricity correction are stored in the sub-storage 119 as the transfer amounts for each transfer amount unit.

Then, using the transfer amounts stored in the sub-storage 119, the misalignment in the sub-scanning direction is adjusted.

Also, misalignment amount for each transfer unit in the sub-scanning direction can be calculated by obtaining the difference between the frequency component B2 in the sub-scanning direction obtained from the first dot group 101 and the third dot group 103 with the frequency component H2 in the sub-scanning direction obtained from the second dot group 102 and the third dot group 103.

Embodiments of Processing by Recording Device

Figure 19:
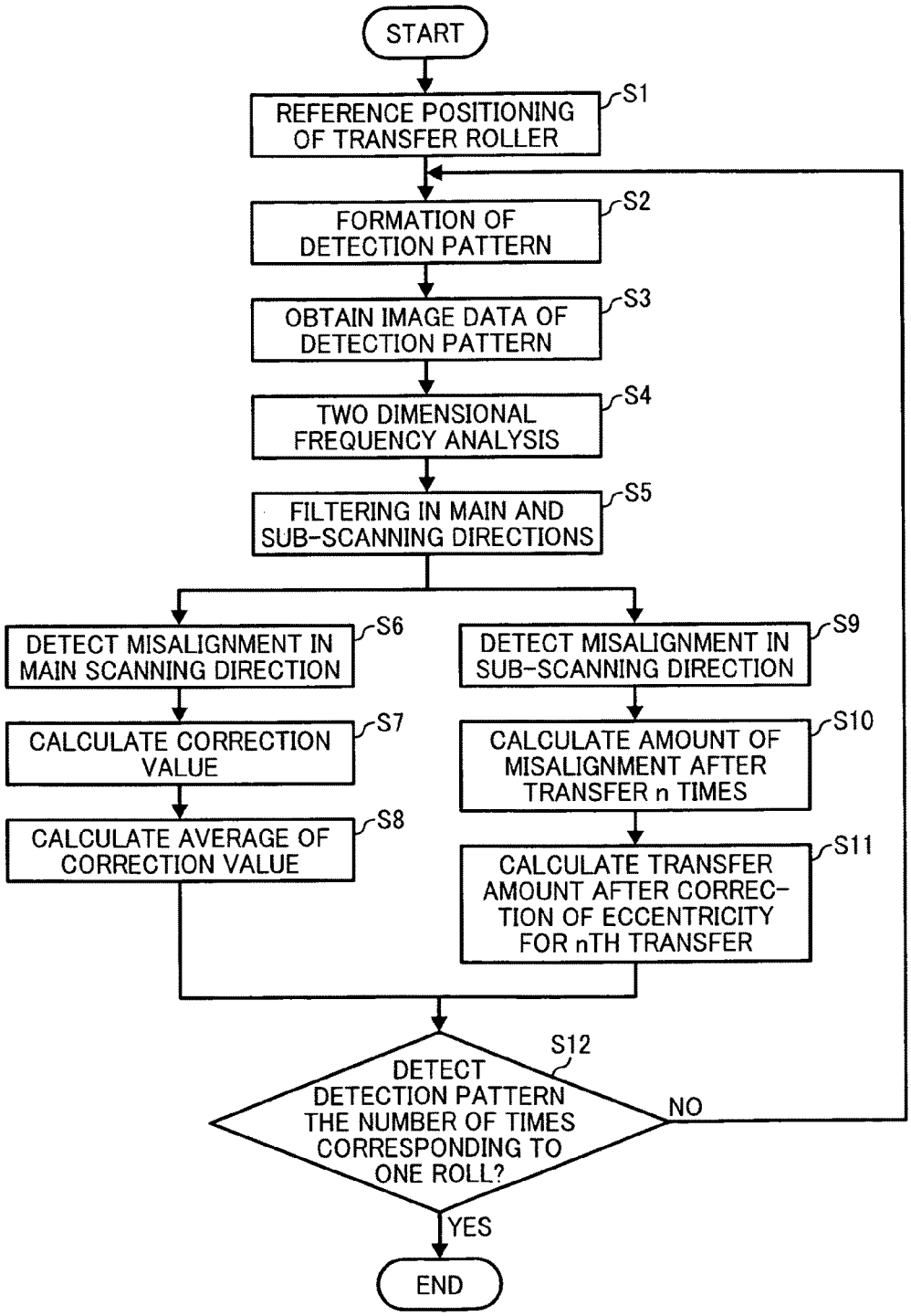
FIG. 19 is a diagram illustrating a processing example of the recording device of the present disclosure.

Next, Embodiments of processing by the recording device of the present disclosure are described with reference to FIG. 19. FIG. 19 is a block chart illustrating an example of the processing for misalignment detection of printing.

First, conduct reference position alignment of the transfer roller 15 (Step S1).

Next, form the detection pattern 100 on the recording medium 16 (Step S2)

Then, detect the detection pattern 100 formed on the recording medium 16 using the two-dimensional sensor 30 to obtain the image data of the detection pattern 100 (Step S3).

Next, conduct two dimension frequency analysis of the image data of the detection pattern 100 to obtain the position data (frequency component) of each dot constituting the detection pattern 100 (Step S4).

Then, conduct filtering treatment in the main scanning direction and sub-scanning direction to separate the misalignment into the misalignment component of printing in the main scanning direction (X axis direction) and the misalignment component of printing in the sub-scanning direction (Y axis direction) (Step S5).

Next, based on the misalignment component of printing in the main scanning direction, detect the misalignment of printing in the main scanning direction (Step S6), and calculate a correction value for adjustment of the print timing signal when conducting printing With regard to the correction value, calculate the correction value for adjusting the print timing for return printing by obtaining the difference between the frequency components A1 and B1 in the main scanning direction obtained from the first dot group 101 and the second dot group 102 and the predetermined reference frequency H1 in the main scanning direction.

Next, calculate the average of the correction values obtained multiple times in Step S7 so far (Step S8).

The average can be calculated by dividing the correction values calculated a times in Step S7 by $\alpha$. $\alpha$ represents the number of calculation times of the correction values every time the transfer roller 15 transfers the recording medium 16 after the reference position alignment in Step S1 and $\alpha$ is equal to n.

n is n=1 the first time the detection pattern 10 is formed after the reference position alignment and n represents the number that increases one by one (=n+1) every time the answer to "Detect detection pattern the number of time corresponding to one roll? (Step S12)" is "No".

That is the number to which one is added every time the transfer roller moves the recording medium one transfer unit.

When n reaches N (meaning the number of transfer times when the transfer roller 15 rotates one round), the answer to "Detect detection pattern the number of time corresponding to one roll?" is "Yes".

Detect misalignment of printing in the sub-scanning direction based on the misalignment component in the sub-scanning direction (Step S9) and calculate the misalignment amount of printing in the sub-scanning direction n times (Step S10).

The misalignment amount is the misalignment of printing for each transfer amount unit in the sub-scanning direction calculated based on the difference obtained by comparing the frequency component B2 in the sub-scanning direction obtained from the first dot group 101 and the third dot group 103 with the predetermined reference frequency H2 in the sub-scanning direction.

Next, calculate the transfer amount of n time transfer after eccentricity correction based on the misalignment amount calculated in the Step S10.

Next, determine whether the detection patterns 100 for one roll of the transfer roller 15 have been detected (Step S12) and repeat the processing described above until the detection patterns 100 for one roll of the transfer roller 15 are detected.

End the processing when the detection patterns 100 for one roll of the transfer roller 15 are detected (Yes to S12).

With regard to the formation of the first dot group 101, the second dot grout, 102, and the third dot group 103, dots can be sequentially printed in the main scanning direction in the range within the detection area of the two-dimensional sensor 30.

In addition, with regard to printing in the sub-scanning direction, dots can be printed in the range within the detection area of the two-dimensional sensor 30 if the printing area is equal to or smaller than one transfer amount of the transfer roller 15.

Therefore, many printed dots can be used as the image data so that the detection accuracy of the misalignment of printing can be improved.

Characteristics of Recording Device of Present Disclosure

As described above, the recording device of the present disclosure forms the first dot group 101 when the carriage is moving in the outward direction.

Next, after transferring the recording medium 10 in a predetermined amount on which the first dot group 101 is formed, the second dot group 102 is formed at the timing of printing dots in the center between the two adjacent dots constituting the first dot group 101.

In addition, the third dot group 103 is formed at the timing of forming the dots at the same position in the main scanning direction as the first dot group 101 and the second dot group 102 to form the detection pattern 100 constituted of the first dot group 101, the second dot group 102, and the third dot group 103.

Next, the detection pattern 100 formed is detected by the two-dimensional sensor 30 to obtain the image data of the detection pattern 100. The thus obtained image data are analyzed to obtain the characteristics of the two dimension frequency of the detection pattern 100.

Then, misalignment in the main scanning direction between the dots constituting the first dot group 101 and the dots constituting the second dot group 102 and the transfer misalignment in the sub-scanning direction between the dots constituting the first dot group 101 and the dots constituting the third dot group 103 are detected based on the two dimension frequency characteristics.

Therefore, the recording device of the present disclosure is able to exactly detect misalignment in the main scanning direction and the sub-scanning direction.

Second Embodiment

Next, the second embodiment is described.

Misalignment of printing in the main scanning direction is necessary to be adjusted in a recording device employing a system for high speed printing using a recording head group formed of multiple recording heads 6 arranged to print the same color dots or for color printing using a recording head group formed of multiple recording heads 6 arranged to print different color dots.

Therefore, in this embodiment, the detection pattern 100 is formed on the recording medium 16 for each of the recording heads 6 to detect misalignment of printing in the main scanning direction for each of the recording heads 6.

Therefore, the misalignment of printing in the main scanning direction can be adjusted based on the detected misalignment of printing in the main scanning direction for each of the recording heads 6.

The second embodiment is described in detail below.

The recording device of the present disclosure forms the detection pattern 100 constituted of the first dot group 101, the second dot group 102, and the third dot group 103 on the recording medium 16.

The detection pattern 100 formed on the recording medium 16 for each of the recording heads 6 is detected by the two-dimensional sensor 30 and the image data of the detection pattern 100 are obtained for each of the recording heads 6.

Next, the image data of the detection pattern 100 obtained for each of the recording heads 6 are subject to two dimension frequency analysis to obtain the position data (frequency component) of each dot constituting the detection pattern 100 for each of the recording heads 6.

Next, misalignment of printing between the dots constituting the first dot group 101 and the dots constituting the second dot group 102 are detected for each of the recording heads 6 based on the position data (frequency component) of each dot constituting the detection pattern 100.

Next, correction values for each of the recording heads 6 are calculated based on the detected misalignment of printing to adjust the print timing signal for return printing.

Then, the correction values calculated for each of the recording heads 6 are stored in the sub-storage 119 and used when images are formed to print dots in the main scanning direction.

Therefore, the misalignment of printing in the main scanning direction can be adjusted based on the detected misalignment of printing in the main scanning direction for each of the recording heads 6.

Third Embodiment

Next, the third embodiment is described.

As described in the second embodiment, assembly error of each of the recording head 6 has an impact in the recording device that forms images by a recording head group constituted of arranged multiple recording heads 6.

Therefore, it is suitable to correct the assembly error among the multiple recording heads 6.

The recording device of this embodiment corrects the assembly error of the recording heads 6 in the main scanning direction.

Therefore, misalignment of printing caused by the assembly error in the main scanning direction can be reduced.

Below is the description about the correction method of the assembly error in the main scanning direction.

Misalignment of printing for return and outward printing for each of the recording head 6 is corrected before correction of the assembly error.

First, the dots constituting the first dot group 101 are printed a constant distance apart in the main scanning direction and the sub-scanning direction using the recording head (reference head) to form the first dot group 101 on the recording medium 16.

The distance between the dots can be arbitrarily determined in each of the directions.

Then, the dots constituting the second dot group 102 are printed in the center between the dots constituting the first dot group 101 using a target recording head (adjustment head) to form the second dot group 102 on the recording medium 16.

Figure 20:
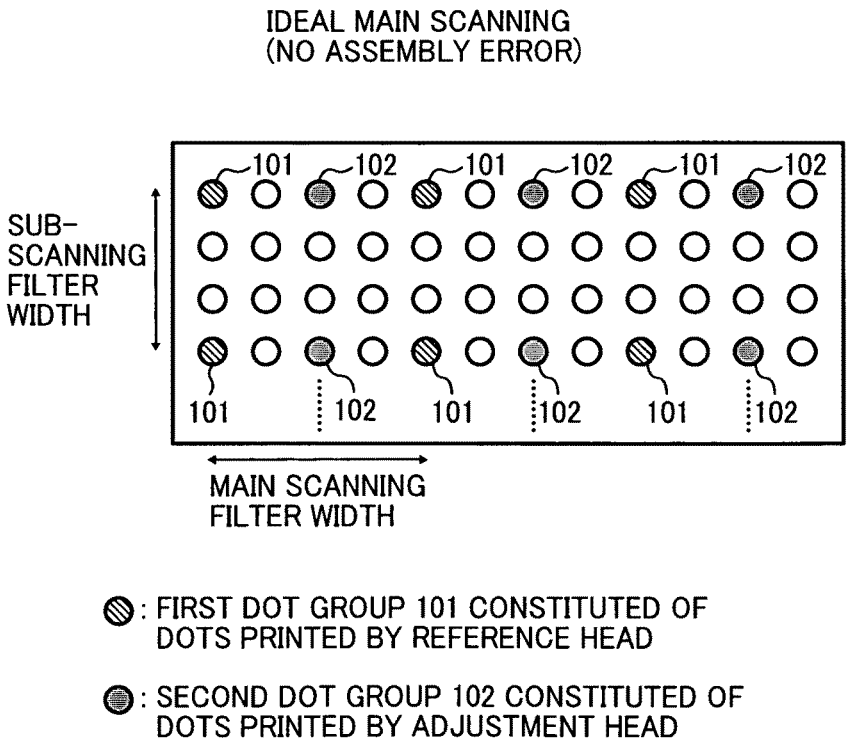
FIG. 20 is a first diagram illustrating a third Embodiment described later and the detection pattern 100 with no assembly error in the main scanning direction.

If the recording heads 6 are ideally assembled, the dots constituting the first dot group 101 and the dots constituting the second dot group 102 are formed a constant distance apart along the main scanning direction as illustrated in FIG. 20.

Figure 21A:
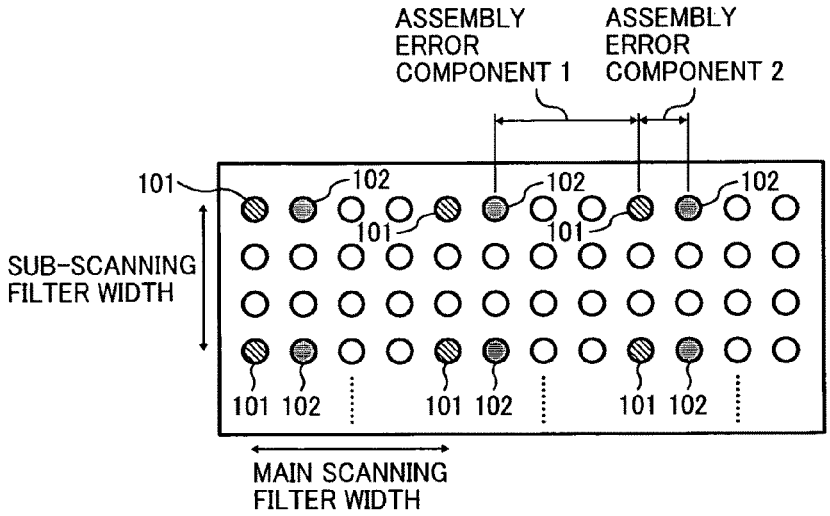
FIGS. 21A and 21B are second and third diagrams illustrating the third Embodiment and the detection pattern 100 with an assembly error in the main scanning direction.

To the contrary, if the adjustment head has an assembly error in the main scanning direction relative to the reference head, the dots constituting the second dot group 102 are printed in the main scanning direction at positions away from the ideal positions, thereby causing misalignment of printing in the main scanning direction as illustrated in FIG. 21A.

The recording device of this embodiment detects the detection pattern 100 formed of the first dot group 101 and the second dot group 102 illustrated in FIG. 21A by the two-dimensional sensor 30 to obtain image data of the detection pattern 100. Next, two dimension frequency analysis is conducted for the image data of the detection pattern 100 to obtain the position data of each dot constituting the detection pattern 100.

Figure 21B:
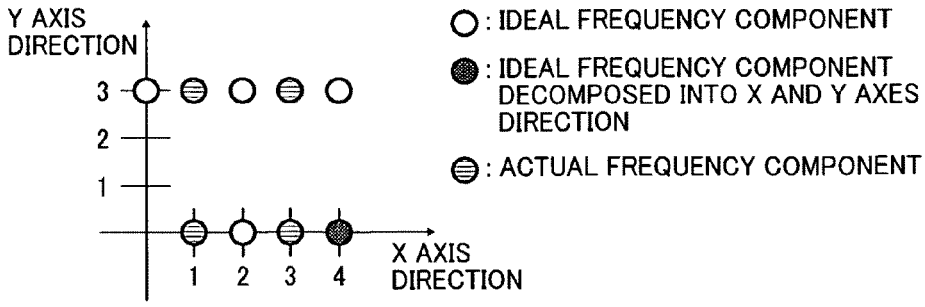

Therefore as illustrated in FIG. 21B, the misalignment component of the second dot group 102 formed by the adjustment head appears in the frequency component on the X axis as the frequency component different from the ideal frequency component.

That is, a frequency component appears which is different from the frequency component for the reference frequency.

Therefore, the amount of the assembly error in the main scanning direction can be obtained.

The recording device of this embodiment detects misalignment of printing in the main scanning direction by calculating the difference obtained by comparing the frequency component in the main scanning direction with the reference frequency (frequency component at ideal state) in the main scanning direction illustrated in FIG. 21B.

For example, unless misalignment occurs in the main scanning direction, when the reference frequency (frequency component at ideal state) in the main scanning direction is obtained, the difference is zero. Therefore, it can be determined that no misalignment in the main scanning direction Occurs.

In addition, if misalignment occurs in the main scanning direction, frequency components different from the reference frequency (frequency component at ideal state) are obtained, meaning that a difference is obtained. Therefore, misalignment in the main scanning direction (caused by the assembly error) can be detected.

Misalignment in the main scanning direction can be adjusted by adjusting the print timing signal for return printing based on the difference obtained by comparing the frequency component {frequency component different from the reference frequency (frequency component at ideal state)} in the main scanning direction obtained when misalignment occurs with the predetermined reference frequency (frequency component at ideal state) in the main scanning direction.

Fourth Embodiment

Next, the fourth embodiment is described.

In the third embodiment, the assembly error in the main scanning direction is described.

In the fourth embodiment, the assembly error in the sub-scanning direction is described.

First, the dots constituting the first dot group 101 are printed a constant distance apart in the main scanning direction using the recording head (reference head) to form the first dot group 101 on the recording medium 16.

The distance between the dots can be arbitrarily determined.

Then, the dots constituting the second dot group 102 are printed at the position with a regulated number of pixels (the sub-scanning printing regulated width) distant from the dots constituting the first dot group 101 relative to the sub-scanning direction using a target recording head (adjustment head) to form the second dot group 102.

Figure 22:
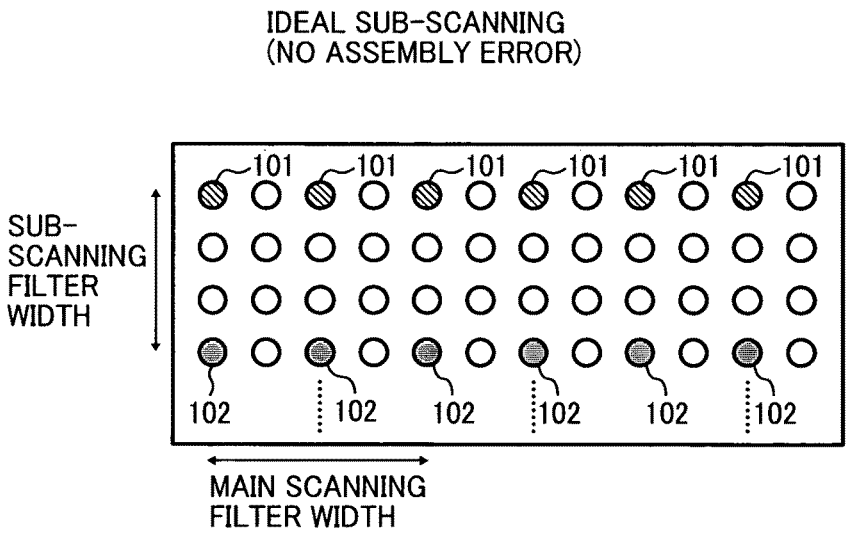
FIG. 22 is a first diagram illustrating a fourth Embodiment described later and the detection pattern 100 with an assembly error in the sub-scanning direction.

If the recording heads 6 are ideally assembled, the dots constituting the first dot group 101 and the dots constituting the second dot group 102 are formed a constant distance apart along the sub-scanning direction as illustrated in FIG. 22.

Figure 23A:
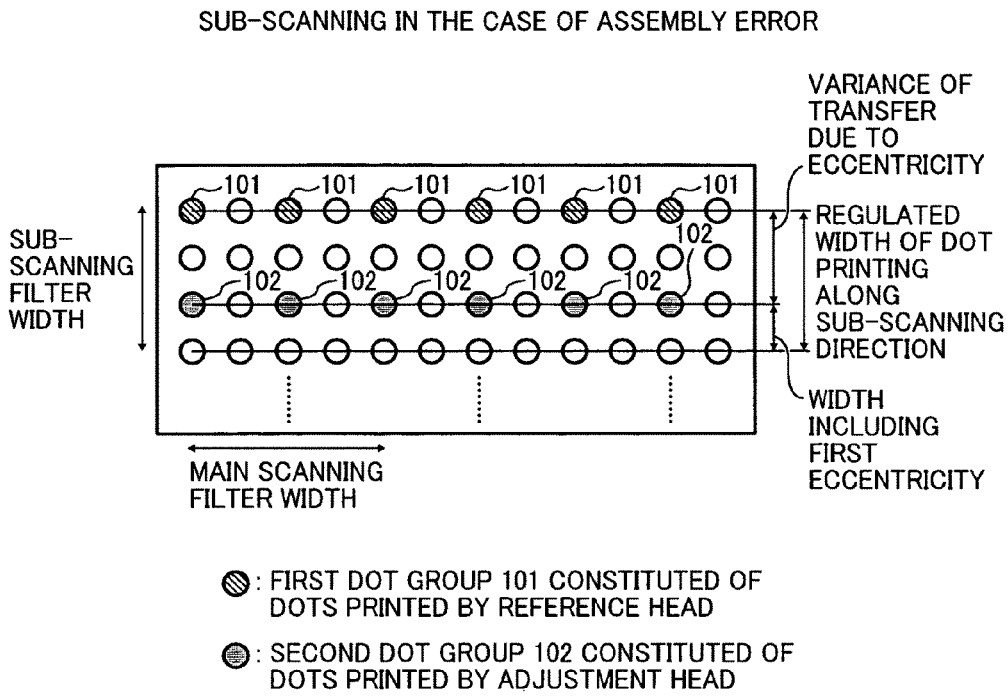
FIGS. 23A and 23B are second and third diagrams illustrating the fourth Embodiment and the detection pattern 100 with an assembly error in the sub-scanning direction.

To the contrary, if the adjustment head has an assembly error in the sub-scanning direction relative to the reference head, the dots constituting the second dot group 102 are printed in the sub-scanning direction at positions away from the ideal positions, thereby causing misalignment of printing in the sub-scanning direction as illustrated in FIG. 23A.

Figure 23B:
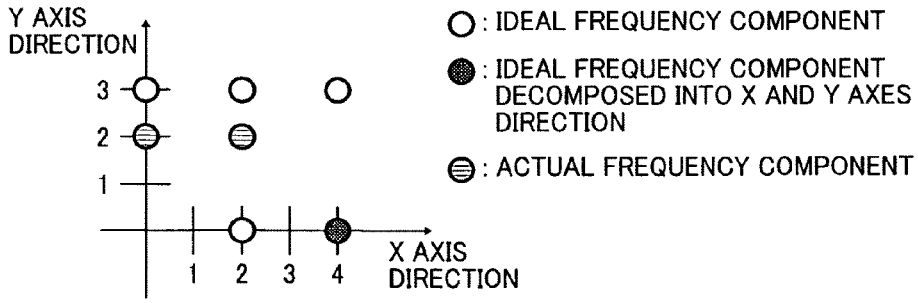

The recording device of this embodiment detects the detection pattern 100 formed of the first dot group 101 and the second dot group 102 illustrated in FIG. 23A by the two-dimensional sensor 30 to obtain image data of the detection pattern 100. Next, two dimension frequency analysis is conducted for the image data of the detection pattern 100 to obtain the position data of each dot constituting the detection pattern 100. Therefore as illustrated in FIG. 23B, the misalignment component of the second dot group 102 formed by the adjustment head appears in the frequency component on the Y axis as the frequency component different from the ideal frequency component. That is, a frequency component appears which is different from the frequency component for the reference frequency.

Therefore, the amount of the assembly error in the sub-scanning direction can be obtained.

The recording device of this embodiment detects misalignment of printing in the sub-scanning direction by calculating the difference obtained by comparing the frequency component in the sub-scanning direction with the reference frequency (frequency component at ideal state) in the sub-scanning direction illustrated in FIG. 23B.

For example, unless misalignment occurs in the sub-scanning direction, when the reference frequency (frequency component at ideal state) in the sub-scanning direction is obtained, the difference is zero. Therefore, it can be determined that no misalignment in the sub-scanning direction occurs.

In addition, if misalignment occurs in the sub-scanning direction, a frequency components different from the reference frequency (frequency component at ideal state) are obtained, meaning that a difference is obtained. Therefore, misalignment in the sub-scanning direction (caused by the assembly error) can be detected.

Misalignment in the sub-scanning direction can be adjusted by adjusting the nozzles based on the difference obtained by comparing the frequency component {frequency component different from the reference frequency (frequency component at ideal state)} in the sub-scanning direction obtained when misalignment occurs with the predetermined reference frequency (frequency component at ideal state) in the sub-scanning direction.

The embodiments described above are preferable embodiments of the present disclosure and thus the present invention is not limited thereto.

For example, in the embodiment described above, the first dot group 101' on the upstream side of the nozzles illustrated in FIG. 6 is formed on the recording medium 16 by using the nozzles on the upstream side when forming the second dot group 102 and the third dot group 103 using the nozzles on the downstream side. In addition, second dot group 102' (not shown) and third dot group 103' (not shown) that constitute the detection pattern 100 together with the first dot group 101' are formed on the recording medium 16 using the nozzles situated on the downstream side after the transfer medium 16 on which the first dot group 101' is formed is transferred one transfer unit.

In addition, the following method can be used if the detection pattern 100 can be formed.

For example, first dot group 101' on the upstream side illustrated in FIG. 6 is formed by printing dots constituting the first dot group 101' with a predetermined distance on the recording medium 16 using the nozzles on the upstream side while moving the carriage 5 in the outward direction after the second dot group 102 and the third dot group 103 are formed using the nozzles on the downstream side. In addition, second dot group 102' (not shown) and third dot group 103' (not shown) that constitute the detection pattern 100 together with the first dot group 101' are formed on the recording medium 16 using the nozzles situated on the downstream side after the transfer medium 16 on which the first dot group 101' is formed is transferred one transfer unit.

The nozzles for forming the third dot group 103 are not necessarily limited to the nozzles situated on the downstream side among the nozzles. The nozzles located away from a predetermined amount relative to the transfer direction can be used within the range in which the two-dimensional sensor 30 can read at once using the nozzles used to form the second dot group 102.

In addition, when color images are formed in the recording device of the embodiments, the recording device can process the same as that in those embodiments described above by structuring to deal with color data by the two-dimensional sensor 30 and pixel data using color data for two dimension frequency analysis.

In addition, control operation for each unit that constitutes the recording device of the present disclosure can be conducted by hardware and/or software, With regard to use of software, it is possible to conduct processing by software by installing a program that records processing sequences in computer installed into hardware dedicated thereto.

Alternatively, processing can be conducted by installing a program in a general-purpose computer that can perform various kinds of processing.

For example, such programs can be preliminarily stored in hard disk or ROM (Read Only Memory) as a recording medium.

Alternatively, programs can be stored temporarily or eternally in a removable recording medium.

Such removable recording media can be supplied as package software.

Such removable discs include FLOPPY (Registered) disks, CD-ROMs (Compact Disc Read Only Memory), MOs (Magneto optical) Discs), DVDs (Digital Versatile Disc), Magnetic discs, semiconductor memories, etc.

The programs are installed from the removable discs described above are into a computer.

Alternatively, the programs are transmitted from a download site to a computer wirelessly.

Alternatively, the programs can be transferred into a computer via a network.

In addition, the recording device of the present disclosure can conduct the processing described in the embodiments described above not only in a chronological order but also in parallel or individually depending on the processing capacity or on the necessity basis.

This document claims priority and contains subject matter related to Japanese Patent Application no. 2010-025391, filed on Feb. 8, 2010, the entire contents of which are hereby incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A recording device, comprising:

a recording head including a nozzle line having multiple nozzles that eject ink and are arranged in a transfer direction of a recording medium;

a carriage onto which the recording head is mounted;

a moving device that moves the carriage forward and backward in a direction perpendicular to the transfer direction of the recording medium;

a transfer device that transfers the recording medium;

an ejection control device that forms a detection pattern on the recording medium by ejecting the ink from the nozzles at an arbitrary timing to print dots on the recording medium with the ink when the carriage is moving in a forward direction and a backward direction;

a two-dimensional sensor that detects the detection pattern formed on the recording medium and obtains image data of the detection pattern;

an analyzer that analyzes the image data of the detection pattern obtained by the two-dimensional sensor and obtains two-dimension frequency characteristics of the detection pattern; and a detection device that detects misalignment of the dots printed when the carriage is moving in the forward direction and the backward direction based on the two-dimension frequency characteristics obtained by the analyzer via detection of a difference between the obtained two-dimension frequency characteristics and a set reference frequency characteristics, the ejection control device including:

a first dot group formation device that forms a first dot group on the recording medium when the carriage is moving in the forward direction by ejecting the ink multiple times to print the dots a constant distance apart in the direction perpendicular to the transfer direction using the nozzles located on an upstream side among the nozzles in the nozzle line relative to the transfer direction, a second dot group formation device that forms a second dot group on the recording medium by ejecting the ink multiple times using nozzles situated a set distance downstream from the nozzles used to form the first dot group relative to the transfer direction at a timing of printing dots at a center position between two adjacent dots constituting the first dot group when the carriage is moving in the backward direction after the transfer device transfers the recording medium in a set amount, and a third dot group formation device that forms a third dot group on the recording medium when the carriage is moving in the backward direction by ejecting the ink multiple times with nozzles situated a set distance from the nozzles used to form the second dot group relative to the transfer direction at a timing of printing dots at the same positions in the direction perpendicular to the transfer direction as the dots constituting the first dot group and the dots constituting the second dot group in the direction perpendicular to the transfer direction, wherein the detection pattern includes the first dot group, the second dot group, and the third dot group, and the detection pattern is formed so that the first dot group, the second dot group, and the third dot group are not superimposed one above the other, and wherein if misalignment occurs, the distance between dots constituting the first dot group formed when moving in the forward direction and the dots constituting the second dot group formed when moving in the backward direction is inconsistent so that data obtained from the detection pattern constituted of the first dot group, the second dot group, and the third dot group contain misalignment component.

2. The recording device according to claim 1, wherein misalignment between the dots constituting the first dot group and the dots constituting the second dot group and misalignment of printing between the dots constituting the first dot group and the dots constituting the third dot group are detected based on the two-dimension frequency characteristics obtained by the analyzer.

3. The recording device according to claim 2, wherein misalignment between the dots constituting the first dot group and the dots constituting the second dot group is detected by comparing frequency characteristics in the direction perpendicular to the transfer direction with a set reference frequency in the direction perpendicular to the transfer direction, and misalignment between the dots constituting the first dot group and the dots constituting the third dot group is detected by comparing frequency characteristics in the transfer direction with a set reference frequency in the transfer direction using the two-dimension frequency characteristics obtained by the analyzer.

4. The recording device according to claim 2, wherein the detection device detects misalignment between the dots constituting the first dot group and the dots constituting the second dot group by comparing frequency characteristics in the direction perpendicular to the transfer direction obtained by the dots constituting the first dot group and the dots constituting the second dot group with frequency characteristics in the transfer direction obtained by the dots constituting the third dot group, and misalignment between the dots constituting the first dot group and the dots constituting the third dot group by comparing frequency characteristics in the direction perpendicular to the transfer direction obtained by the dots constituting the first dot group and the dots constituting the third dot group with frequency characteristics in the transfer direction obtained by the dots constituting the second dot group and the dots constituting the third dot group.

5. The recording device according to claim 2, wherein, the recording device further comprises at least one additional recording heads, the ejection control device forms the detection pattern including the first dot group, the second dot group, and the third dot group for each of the recording heads, the two-dimensional sensor detects the detection patterns formed on the recording medium for each of the recording heads and obtain image data of the detection patterns for each of the recording heads, the analyzer analyzes the image data of the detection patterns for each of the recording heads obtained by the two-dimensional sensor and obtains two-dimension frequency characteristics of the detection patterns for each of the recording heads, and the detection device detects misalignment between the dots constituting the first dot group and the dots constituting the second dot group based on the two-dimension frequency characteristics of the detection patterns for each of the recording heads obtained by the analyzer.

6. The recording device according to claim 1, wherein the dots in the first dot group, the second dot group, and the third dot group are formed in only one color.

7. A method of controlling a recording device, the recording device comprising a recording head comprising a nozzle line having multiple nozzles that eject ink and are arranged in a transfer direction of a recording medium;

a carriage onto which the recording head is mounted;

a moving device that moves the carriage forward and backward in a direction perpendicular to the transfer direction of the recording medium;

a transfer device that transfers the recording medium; and an ejection control device that forms a detection pattern on the recording medium by ejecting the ink from the nozzles at an arbitrary timing to print dots on the recording medium with the ink when the carriage is moving in a forward direction and a backward direction, the control method comprising:

detecting the detection pattern formed on the recording medium with a two-dimensional sensor and obtaining image data of the detection pattern;

analyzing the image data of the detection pattern obtained by the two-dimensional sensor and obtaining two-dimension frequency characteristics of the detection pattern;

detecting misalignment of the dots printed when the carriage is moving in the forward direction and the backward direction based on the two-dimension frequency characteristics via detection of a difference between the obtained two-dimension frequency characteristics and a set reference frequency characteristics, forming a first dot group on the recording medium when the carriage is moving in the forward direction by ejecting the ink multiple times to print the dots a constant distance apart in the direction perpendicular to the transfer direction using the nozzles located on an upstream side among the nozzles in the nozzle line relative to the transfer direction, forming a second dot group on the recording medium by ejecting the ink multiple times using nozzles situated a set distance downstream from the nozzles used to form the first dot group relative to the transfer direction at a timing of printing dots at a center position between two adjacent dots constituting the first dot group when the carriage is moving in the backward direction after the transfer device transfers the recording medium in a set amount, and forming a third dot group on the recording medium when the carriage is moving in the backward direction by ejecting the ink multiple times with nozzles situated a set distance from the nozzles used to form the second dot group relative to the transfer direction at a timing of printing dots at the same positions in the direction perpendicular to the transfer direction as the dots constituting the first dot group and the dots constituting the second dot group in the direction perpendicular to the transfer direction, wherein the detection pattern includes the first dot group, the second dot group, and the third dot group, and the detection pattern is formed so that the first dot group, the second dot group, and the third dot group are not superimposed one above the other, and wherein if misalignment occurs, the distance between dots constituting the first dot group formed when moving in the forward direction and the dots constituting the second dot group formed when moving in the backward direction is inconsistent so that data obtained from the detection pattern constituted of the first dot group, the second dot group, and the third dot group contain misalignment component.

8. The method according to claim 7, wherein the dots in the first dot group, the second dot group, and the third dot group are formed in only one color.

* * * * *